US008287065B2

(12) United States Patent
Okazawa et al.

(10) Patent No.: US 8,287,065 B2
(45) Date of Patent: Oct. 16, 2012

(54) RECORDING APPARATUS

(75) Inventors: Yoshiyuki Okazawa, Shiojiri (JP); Kazuhisa Nakamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 525 days.

(21) Appl. No.: 12/467,373

(22) Filed: May 18, 2009

(65) Prior Publication Data

US 2009/0284556 A1 Nov. 19, 2009

(30) Foreign Application Priority Data

May 19, 2008 (JP) ..... 2008-131052

(51) Int. Cl.
*B41J 29/38* (2006.01)
*B41J 11/20* (2006.01)

(52) U.S. Cl. ..... 347/8; 347/5; 400/56

(58) Field of Classification Search ..... 347/5, 8, 347/9, 14, 19; 400/55, 59, 56
See application file for complete search history.

(56) References Cited

U.S. PATENT DOCUMENTS 6,575,543 B2 * 6/2003 Ahn ..... 347/8
7,290,949 B1 * 11/2007 Phillips et al. ..... 400/56

FOREIGN PATENT DOCUMENTS

JP 2004-314591 11/2004

* cited by examiner

*Primary Examiner* — Lam S Nguyen
(74) *Attorney, Agent, or Firm* — Workman Nydegger

(57) ABSTRACT

A recording apparatus includes: a recording head that performs recording on a recording target medium; a driving mechanism that is capable of causing the recording head to move closer to the recording target medium or move away from the recording target medium; and a controlling section that determines driving amount for one driving operation that is performed by the driving mechanism on the basis of results of a comparison made between a first recording head movement direction that is taken or to be taken in the one driving operation and a second recording head movement direction that was taken in another driving operation that is immediately before the one driving operation and thus precedes the one driving operation.

4 Claims, 12 Drawing Sheets

RECORDING APPARATUS

BACKGROUND

1. Technical Field

The present invention relates to a recording apparatus that is provided with a recording head that performs recording on a recording target medium and is further provided with a driving mechanism that is capable of causing the recording head to move in a direction toward the recording target medium and away from the recording target medium. In the following description of this specification, the term "recording apparatus" according to an aspect of the present invention encompasses various kinds of apparatuses, devices, machines, equipment, and the like such as an ink-jet printer, a wire dot printer, a laser printer, a line printer, a copying machine, and a facsimile machine, though not limited thereto.

2. Related Art

As described in JP-A-2004-314591, a recording apparatus of related art is provided with a carriage, a platen, a guiding unit, a working unit, and a power transmission unit. The platen is an example of a recording target medium supporting unit. The guiding unit is an example of a carriage-supporting unit. The working unit and the power transmission unit make up an example of a driving mechanism. The carriage is provided with a recording head that performs recording such as printing on a sheet of printing paper. Printing paper is a non-limiting example of a recording target medium. The recording head is provided in such a manner that it can move together with the carriage in the direction of the width of a sheet of printing paper. The platen is provided opposite to the recording head so as to support a sheet of printing paper. The guiding unit supports the carriage in such a manner that the carriage can reciprocate in the paper-width direction as guided by the guiding unit. The working unit, which is, for example, a movement force application unit, is configured to move the guiding unit in a direction along which the recording head and the platen are provided opposite to each other. The power transmission unit can transmit driving power from a driving power source to the working unit.

Since a recording apparatus of the related art has a configuration explained above, it is possible to transmit power to the working unit through the driving operation of the driving power source. As the working unit applies a moving force to the guiding unit under the transmitted power, the guiding unit is moved in the direction along which the recording head and the platen face each other. As a result of such operation, a recording apparatus of the related art is capable of switching over the positions of a so-called platen gap, which is a distance between the recording head and the platen. The power transmission unit includes a plurality of gears. Because of such a configuration, so-called backlash, which is a gear tolerance, occurs when the driving power source is operated in a normal rotation direction or a reverse rotation direction. In an effort to provide a technical solution to a backlash problem, a sensor and a light-shielding plate are provided for measuring the position and the phase of the working unit. In such a related-art configuration, the sensor is an example of a detection device, whereas the light-shielding plate is an example of a detection target object. With the use of such a detection mechanism, a recording apparatus of the related art makes a judgment on the position and the phase of the working unit for the controlling thereof. Specifically, a recording apparatus of the related art is configured in such a manner that the sensor detects the light shielding plate in a "stable" area where a platen gap does not change even when the phase of the working unit changes. Having such a configuration, a recording apparatus of the related art is capable of controlling the position of the recording head and performing a platen-gap switchover with high precision.

However, a recording apparatus of the related art has a disadvantage in that its hardware configuration is less simplified because it requires for the sensing unit explained above. In addition, it is likely that, or at least there is an adverse possibility that, the production cost thereof increases because the sensing unit must be provided.

SUMMARY

An advantage of some aspects of the invention is to provide a recording apparatus that is capable of carrying out a platen-gap switchover without requiring a complex hardware configuration.

In order to address the above-identified problems without any limitation thereto, a recording apparatus according to a first aspect of the invention includes: a recording head that performs recording on a recording target medium; a driving mechanism that is capable of causing the recording head to move closer to the recording target medium or move away from the recording target medium; and a controlling section that determines driving amount for one driving operation that is performed by the driving mechanism on the basis of results of a comparison made between a first recording head movement direction that is taken or to be taken in the one driving operation and a second recording head movement direction that was taken in another driving operation that is immediately before the one driving operation and thus precedes the one driving operation, wherein the driving amount that is determined when it is judged that the first recording head movement direction is different from the second recording head movement direction is not the same as the driving amount that is determined when it is judged that the first recording head movement direction is the same as the second recording head movement direction.

A recording apparatus according to the first aspect of the invention described above is provided with the controlling section. Therefore, when a distance from the recording head to a recording target medium is changed through the operation of the driving mechanism, it is possible to drive, for example, operate or perform driving control on, the driving mechanism with the addition of a predetermined correction value if it is judged that the first recording head movement direction is different from the second recording head movement direction. That is, it is possible to drive the driving mechanism with the addition of the predetermined correction value so as to make compensation for transmission loss in the driving mechanism. As a result, it is possible to move the recording head in a range in which the recording head moves in a direction toward a recording target medium or away from the recording target medium with high precision. The configuration explained above is especially effective as a solution to the problem of so-called backlash, which is a tolerance of gears and the like, when the driving mechanism includes the gears.

In order to address the above-identified problems without any limitation thereto, a recording apparatus according to a second aspect of the invention includes: a recording head that performs recording on a recording target medium; a driving mechanism that is capable of causing the recording head to move closer to the recording target medium or move away from the recording target medium; a first movement range delimiting section that determines the position of one end in a movement range of the recording head; a second movement range delimiting section that determines the position of the other end in the movement range; and a controlling section that performs driving control for moving the recording head to the one end until it becomes impossible for the recording head to move further because the movement thereof is limited by the first movement range delimiting section and thereafter moving the recording head to the other end until it becomes impossible for the recording head to move further because the movement thereof is limited by the second movement range delimiting section so as to acquire the amount of the driving operation as reference driving amount and then determines driving amount for one driving operation that is performed by the driving mechanism on the basis of the reference driving amount.

A recording apparatus according to the second aspect of the invention described above is provided with the controlling section. The controlling section makes it possible to perform driving control for moving the recording head to the one end until it becomes impossible for the recording head to move further because the movement thereof is limited by the first movement range delimiting section and thereafter moving the recording head to the other end until it becomes impossible for the recording head to move further because the movement thereof is limited by the second movement range delimiting section so as to acquire the amount of the driving operation as reference driving amount and then determine driving amount for one driving operation that is performed by the driving mechanism on the basis of the reference driving amount.

In other words, since a recording apparatus according to the second aspect of the invention described above is provided with the controlling section, it is possible to calculate a correction value on the basis of a difference between the theoretical value of driving amount of the driving mechanism and the actual value of driving amount for one driving operation that is performed by the driving mechanism after causing or as a result of causing the recording head to move from the one end in the movement range in which the recording head moves in a direction toward a recording target medium or away from the recording target medium to the other end in the movement range. Then, when a distance from the recording head to a recording target medium is changed through the operation of the driving mechanism, it is possible to drive the driving mechanism with the addition of the calculated correction value. Thus, a recording apparatus according to the second aspect of the invention described above offers the same advantageous effects as those offered by a recording apparatus according to the first aspect of the invention described above. It is preferable to perform the calculation of the correction value at each time when a recording apparatus according to the second aspect of the invention is powered ON. With such a preferred configuration, it is possible to cope with a change with passage of time. In addition, it is possible to compensate variations in precision, which differs from the parts/members/components of one recording apparatus to another.

In the configuration of a recording apparatus according to the second aspect of the invention described above, it is preferable that, if the direction of the movement of the recording head at the time of the start of current movement operation when changing a distance from the recording head to a recording target medium is different from the direction of the movement of the recording head at the time of the completion of the last change of the distance, the controlling section should make the determination on the basis of the reference driving amount and drive the driving mechanism, which constitutes a third preferred mode of the invention. In addition to the advantageous effects of the invention offered by a recording apparatus according to the second aspect of the invention, a recording apparatus according to the third preferred mode of the invention offers the following advantages. If the direction of the movement of the recording head at the time of the start of current movement operation when changing a distance from the recording head to a recording target medium is different from the direction of the movement of the recording head at the time of the completion of the last change of the distance, the controlling section makes the determination on the basis of the reference driving amount and drives the driving mechanism. The addition of the correction value is very effective because it is more susceptible to the effects of backlash in such a case. Moreover, it provides an effective solution to so-called play loss, which is transmission loss in the driving mechanism.

In the configuration of a recording apparatus according to the first aspect of the invention described above, it is preferable that, when the recording head is moved from one intermediate position, which is not an end position, in the movement range in which the recording head moves in a direction toward a recording target medium or away from the recording target medium to another intermediate position in the movement range, the controlling section should perform control so that the recording head moves first from the one intermediate position to one end position in the movement range and thereafter moves therefrom to the another intermediate position, which constitutes a fourth preferred mode of the invention. In addition to the advantageous effects of the invention offered by a recording apparatus according to the first aspect of the invention, a recording apparatus according to the fourth preferred mode of the invention offers the following advantages. When the recording head is moved from one intermediate position, which is not an end position, in the movement range in which the recording head moves in a direction toward a recording target medium or away from the recording target medium to another intermediate position in the movement range, the controlling section performs control so that the recording head moves first from the one intermediate position to one end position in the movement range and thereafter moves therefrom to the another intermediate position. That is, another intermediate position mentioned above is determined while taking the one end as reference. Moreover, since the direction of the movement of the recording head switches over when the recording head moves from the one intermediate position to the one end position, the addition of the correction value is executed. Therefore, it is possible to always move the recording head with high precision even when the recording head is moved from one intermediate position to another intermediate position. That is, there is no adverse possibility that a positional shift gradually occurs in one intermediate position and another intermediate position at each time when the recording head is moved.

In the configuration of a recording apparatus according to the first aspect of the invention described above, it is preferable that, when the recording head is moved from one end position in the movement range in which the recording head moves in a direction toward a recording target medium or away from the recording target medium to other position in the movement range, the controlling section should perform control so as to move the recording head by first driving the driving mechanism in a direction in which the recording head approaches the one end position in the movement range and thereafter driving the driving mechanism in a direction opposite thereto, which constitutes a fifth preferred mode of the invention. In addition to the advantageous effects of the invention offered by a recording apparatus according to the first aspect of the invention, a recording apparatus according to the fifth preferred mode of the invention offers the following advantages. When the recording head is moved from one end position in the movement range in which the recording head moves in a direction toward a recording target medium or away from the recording target medium to other position in the movement range, the controlling section performs control so as to move the recording head by first driving the driving mechanism in a direction in which the recording head approaches the one end position in the movement range and thereafter driving the driving mechanism in a direction opposite thereto. That is, other position mentioned above is determined while taking the one end as reference. Moreover, since the direction of the driving of the driving mechanism switches over at this time, the correction value is added. Therefore, it is possible to always move the recording head with high precision even when the recording head is moved from one end position to other position. Thus, there is no adverse possibility that a positional shift gradually occurs in other position mentioned above at each time when the recording head is moved.

In the configuration of a recording apparatus according to the first aspect of the invention described above, it is preferable that, when the recording head is moved to one end position in the movement range in which the recording head moves in a direction toward a recording target medium or away from the recording target medium, the controlling section should drive the driving mechanism at a high speed when moving the recording head and then should switch over the driving speed of the driving mechanism from the high speed to a low speed when causing the recording head to approach the one end position in the movement range, which constitutes a sixth preferred mode of the invention.

In addition to the advantageous effects of the invention offered by a recording apparatus according to the first aspect of the invention, a recording apparatus according to the sixth preferred mode of the invention offers the following advantages. When the recording head is moved to one end position in the movement range in which the recording head moves in a direction toward a recording target medium or away from the recording target medium, the controlling section drives the driving mechanism at a high speed when moving the recording head and then switches over the driving speed of the driving mechanism from the high speed to a low speed when causing the recording head to approach the one end position in the movement range. For the same reasons as above, it is possible to move the recording head with high precision. In addition, it is possible to operate the driving mechanism at a high speed up to a point immediately before bump contact at the one end position in the movement range. Therefore, it is possible to change a distance from the recording head to a recording target medium in a shorter time than otherwise. Moreover, since the driving speed of the driving mechanism is switched over from the high speed to the low speed before bump contact, there is no or substantially less risk of damaging the driving mechanism or other members.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
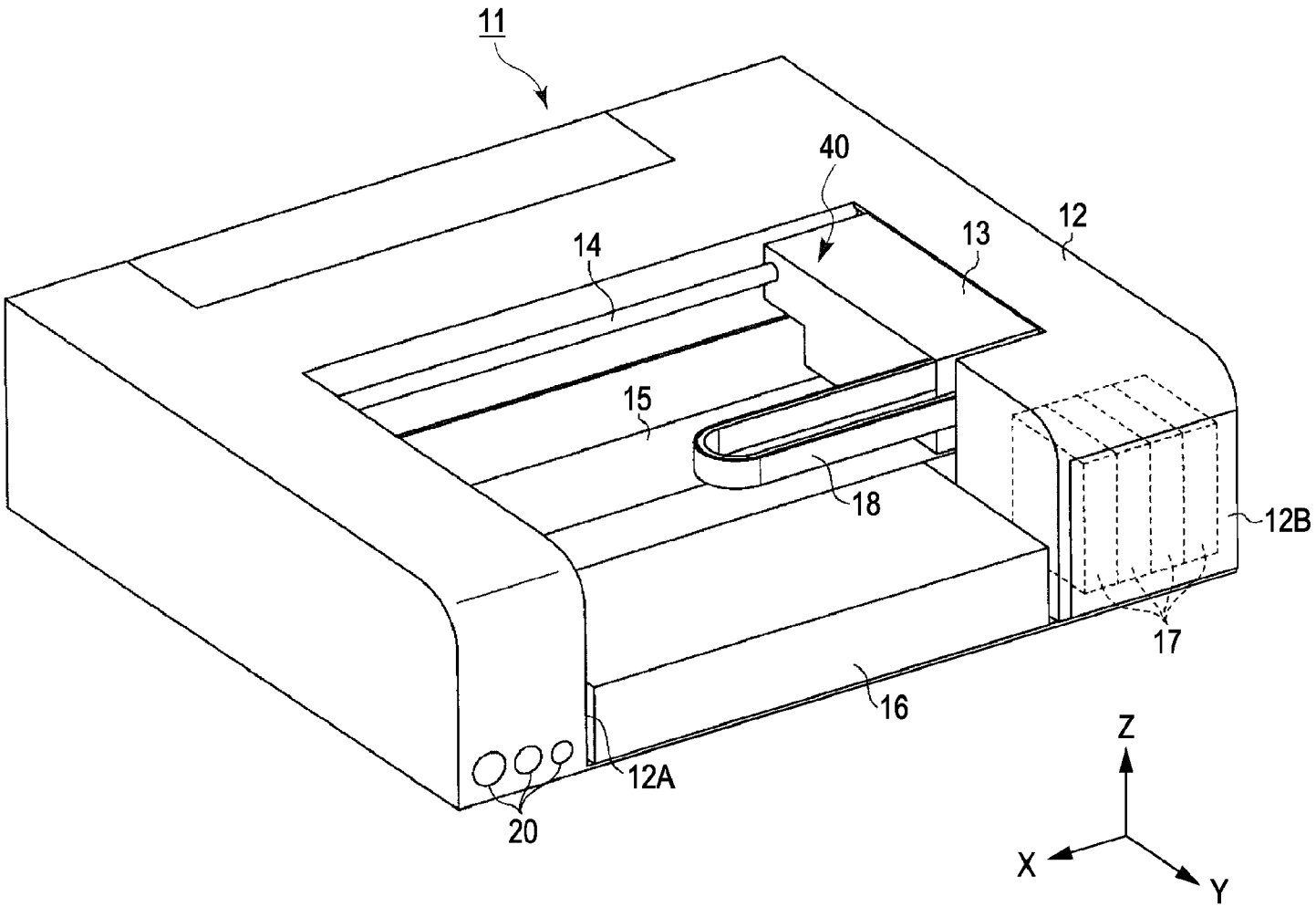
FIG. 1 is a perspective view that schematically illustrates an example of the configuration of a printer, which is an example of an image formation apparatus according to an exemplary embodiment of the invention.

With reference to the accompanying drawings, exemplary embodiments of the present invention will now be explained in detail. FIG. 1 is a perspective view that schematically illustrates an example of the configuration of a printer, which is an example of an image formation apparatus according to an exemplary embodiment of the invention. As illustrated in FIG. 1, a printer 11 has a box-like body 12, which has the shape of a substantially rectangular parallelepiped. A movable carriage 13 is provided in the center space of the body 12 of the printer 11. A guide main shaft 14 is provided in the center space of the body 12 so as to extend in a main scan direction. The carriage 13 can reciprocate along the guide main shaft 14 in the main scan direction. The main scan direction is shown as the horizontal direction in FIG. 1.

As illustrated in FIG. 1, a platen 15 is provided in the center area of the body 12 of the printer 11 when viewed in plan. Specifically, the platen 15, which has the shape of an elongated plate, is provided at a lower position in such a manner that the carriage 13 travels along an upper path extending opposite to the platen 15. The long sides of the elongated platen 15 extend in a direction parallel to the main scan direction. The platen 15 that is described in the present embodiment of the invention is a non-limiting example of a "recording target medium supporting section" according to an aspect of the invention. The lower front part of the body 12 of the printer 11 has an opening or a concavity, which is used as a cassette mounting part 12A. The front face of the printer 11 is shown as the proximal-side face in FIG. 1. A paper-feeding cassette 16 is inserted in and attached to the cassette mounting body part 12A of the printer 11 in a detachable manner. The body 12 of the printer 11 is encased in a cover 12B. A plurality of ink cartridges 17 is housed in the front right corner space inside the cover 12B.

An ink-supply tube, which is not illustrated in the drawing, is connected to each of the plurality of ink cartridges 17. The plurality of ink-supply tubes is attached to a flexible wiring board 18. Ink is supplied from each of the plurality of ink cartridges 17 to the carriage 13 through the corresponding ink-supply tube. A recording head 19 (refer to FIGS. 2, 3, and 5-8) is provided at the lower part of the carriage 13. The ink supplied from the ink cartridges 17 to the carriage 13 is ejected, that is, discharged, from the recording head 19 in the form of ink drops. A pressurizing element, which applies pressure to ink for the ejection thereof, is provided inside the recording head 19 for each nozzle thereof. A few examples of the pressurizing element are a piezoelectric element, an electrostatic element, or a heating element. A voltage having a predetermined level is applied to the pressurizing element. Upon receiving the driving voltage signal, the pressurizing element applies pressure to ink. As a result, the pressurized ink is discharged from the corresponding nozzle as an ink drop.

When printing is performed, a sheet of printing paper P is picked up from the paper-feeding cassette 16 and then transported onto the platen 15. During the movement of the carriage 13 in the main scan direction, the recording head 19, which is moved together the carriage 13, discharges ink drops onto the sheet of printing paper P that is now positioned over the platen 15. In this way, an image corresponding to one line is printed on the sheet of printing paper P. Printing on the sheet of printing paper P is performed by alternating such one-line scan printing operation of the carriage 13 and paper transportation operation by one line at a time, that is, to the next line at each execution of paper transportation. Various operation switches 20 such as a power switch and the like are provided on the lower left part of the front face of the printer body 12.

Figure 2:
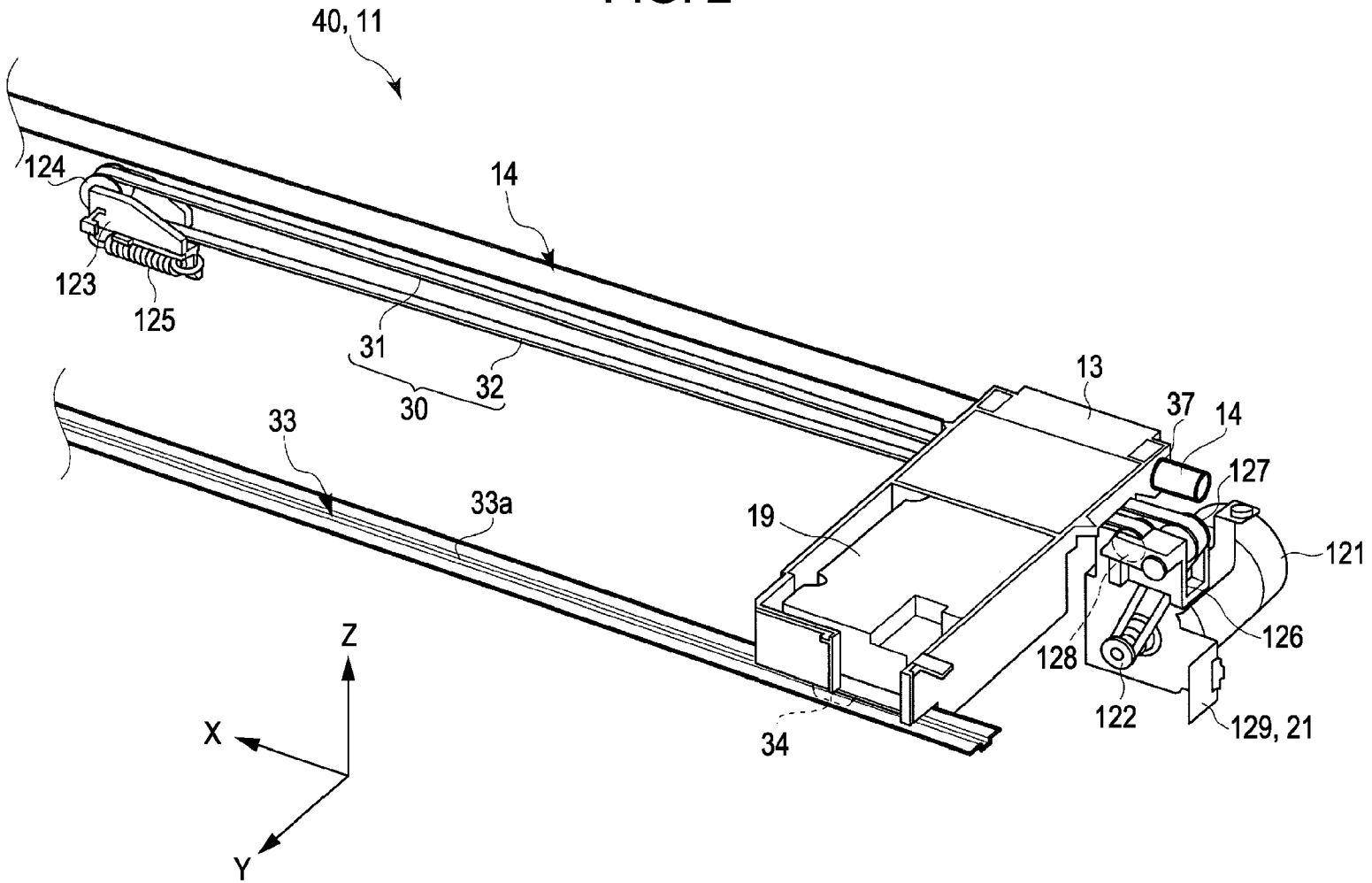
FIG. 2 is a perspective view that schematically illustrates an example of the configuration of a recording unit of an image formation apparatus according to an exemplary embodiment of the invention.

FIG. 2 is a perspective view that schematically illustrates an example of the configuration of a recording unit of an image formation apparatus according to an exemplary embodiment of the invention. As illustrated in FIG. 2, a recording unit 40 includes the carriage 13, the recording head 19, a carriage motor 121, a first pulley 124, a second pulley 127, a third pulley 128, an endless belt 30, the guide main shaft 14, and a guide rail unit 33. The guide main shaft 14 functions as a main guiding shaft. The guide rail unit 33 functions as a sub guiding shaft. The carriage motor 121 is fixed to a motor stay 129 (base member 21). A motor pinion 122 is provided on the shaft of the carriage motor 121. In the following description of the present embodiment of the invention, the right side when viewed from the front of the printer 11 is referred to as "the first (1st) digit side when viewed in the width direction", whereas the left side when viewed from the front of the printer 11 is referred to as "the eightieth (80th) digit side when viewed in the width direction".

An 80th digit side pulley holder 123 is provided at the 80th digit side when viewed in the direction of the width (width direction X) of a sheet of printing paper P. The 80th digit side pulley holder 123 supports the first pulley 124 in such a manner that the first pulley 124 can rotate freely. In addition, the 80th digit side pulley holder 123 supports the first pulley 124 in such a manner that the first pulley 124 can move in the width direction X within a predetermined range. The 80th digit side pulley holder 123 is provided with a coil spring 125. The coil spring 125 urges the first pulley 124 outward when viewed in the width direction X. Since the coil spring 125 applies an outward urging force to the first pulley 124, the endless belt 30 is stretched with an adequate tension. That is, the mechanism explained above can serve as a tension roller.

On the other hand, a 1st digit side pulley holder 126 is provided at the 1st digit side when viewed in the width direction X. The 1st digit side pulley holder 126 supports the second pulley 127 and the third pulley 128 in such a manner that each of the second pulley 127 and the third pulley 128 can rotate freely. The 1st digit side pulley holder 126 and the motor stay 129 are formed as the same single integrated member.

The endless belt 30 is stretched around the motor pinion 122, the first pulley 124, and the second pulley 127. In other words, the endless belt 30 is provided in such a manner that a part of the inner belt surface of the endless belt 30 is in contact with each of a part of the circumferential surface of the motor pinion 122, the first pulley 124, and the second pulley 127. In addition, the endless belt 30 is stretched in such a manner that a part of the outer belt surface of the "lower belt part" 32 of the endless belt 30 is in contact with a part of the circumferential surface of the third pulley 128.

In the preceding sentence, the term "lower belt part" of the endless belt 30 refers to, when viewed in the height direction Z, the lower one of two belt parts stretched between the first pulley 124 and the second pulley 127 in the width direction X. In addition, a part of the upper belt part 31 of the endless belt 30 is in engagement with an engagement member that is provided on the carriage 13 but not illustrated in the drawing. In the preceding sentence, the term "upper belt part" of the endless belt 30 refers to, when viewed in the height direction Z, the upper one of two belt parts stretched between the first pulley 124 and the second pulley 127 in the width direction X.

As the carriage motor 121 is driven, the endless belt 30 moves. Accordingly, the power of the carriage motor 121 is transmitted to the carriage 13. The carriage 13 is provided with a shaft insertion through hole 37 and a convex part 34. The main guiding shaft 14 is inserted through the shaft insertion hole 37 of the carriage 13. The guide rail unit 33 is provided in parallel with the main guiding shaft 14. The guide rail unit 33 has a gutter 33*a*. The convex part 34 of the carriage 13 is in engagement with the gutter 33*a* of the guide rail unit 33. With such a structure, the carriage 13 travels as guided by the main guiding shaft 14 and the guide rail unit 33.

The carriage 13 according to the present embodiment of the invention has a flat shape. That is, the body size of the carriage 13 viewed in the height direction Z is smaller than that viewed in the direction of the width X of a sheet of printing paper P and in the direction of the paper transportation Y, each of which is orthogonal to the height direction Z. Therefore, the position of the main guiding shaft 14 and the position of the guide rail unit 33 are not significantly different from each other when viewed in the height direction Z. Rather, the position of the main guiding shaft 14 and the position of the guide rail unit 33 are significantly different from each other when viewed in the paper transportation direction Y.

Specifically, the shaft insertion hole 37 through which the main guiding shaft 14 is inserted is provided in the neighborhood of an upstream end of the carriage 13 when viewed in the direction of paper transportation. On the other hand, the convex part 34 that is in engagement with the gutter 33*a* of the guide rail unit 33 is provided in the neighborhood of a downstream end of the carriage 13 when viewed in the direction of paper transportation. Since the shaft insertion hole 37 and the convex part 34 of the carriage 13, the main guiding shaft 14, and the guide rail unit 33 are provided in such a positional relationship, it is possible to achieve almost zero so-called "bow" inclination amount in the position/orientation of the recording head 19. The bow inclination amount is the amount of the downward rotation of the paper-transportation downstream side, that is, the convex-part side, of the recording head 19 with the main guiding shaft 14 as the fulcrum.

Figure 3:
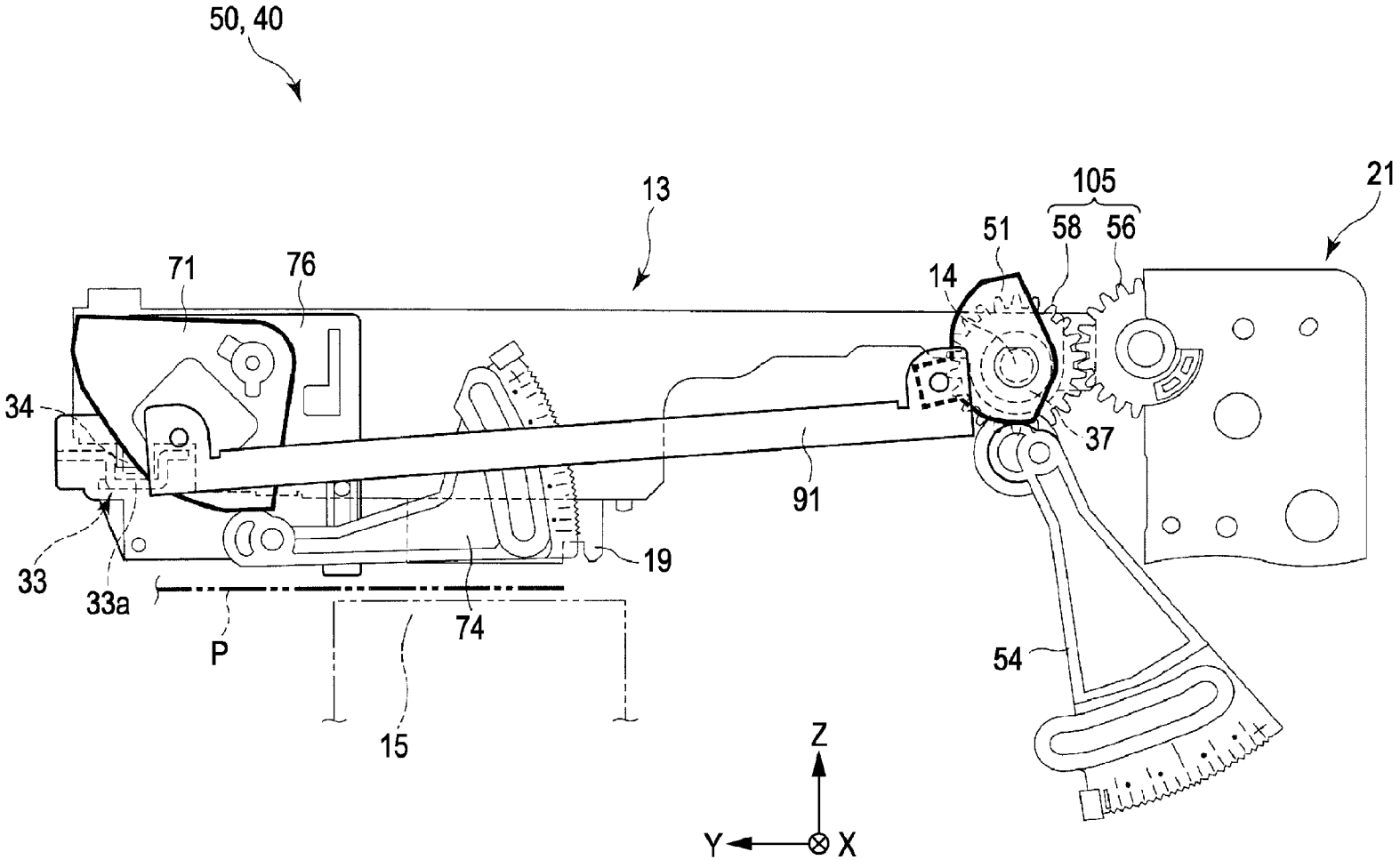
FIG. 3 is a side view that schematically illustrates an example of the configuration of the recording unit of an image formation apparatus according to an exemplary embodiment of the invention.
Figure 4:
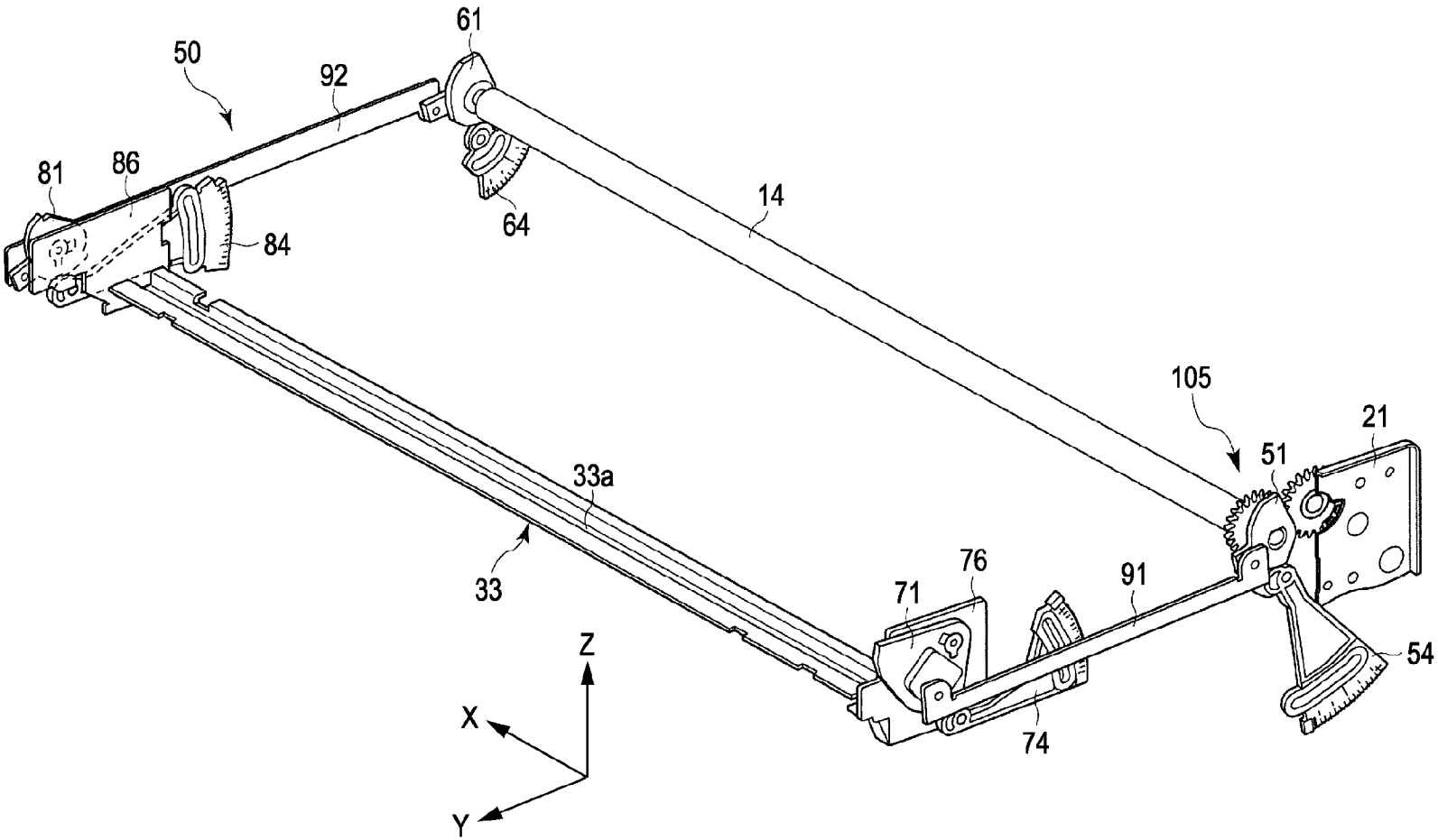
FIG. 4 is a perspective view that schematically illustrates an example of the configuration of a platen gap (PG) adjustment unit of an image formation apparatus according to an exemplary embodiment of the invention.
Figure 5A:
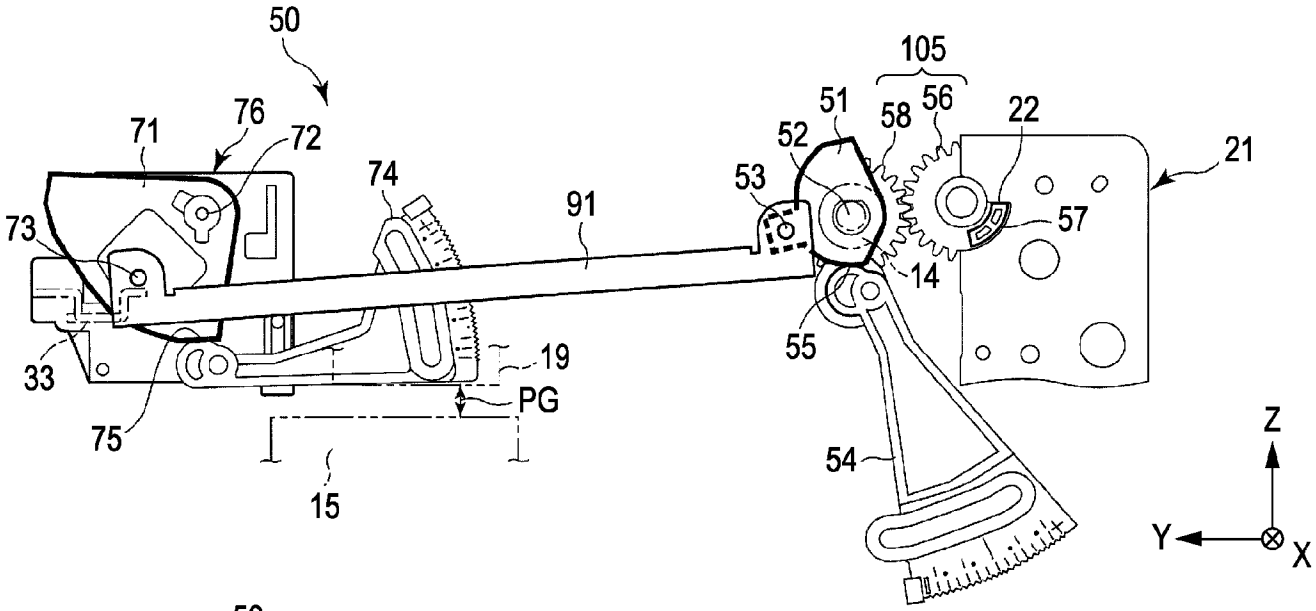
FIGS. 5A and 5B are a set of side views that schematically illustrates an example of the positional state of the PG adjustment unit when it is in a first position.
Figure 5B:
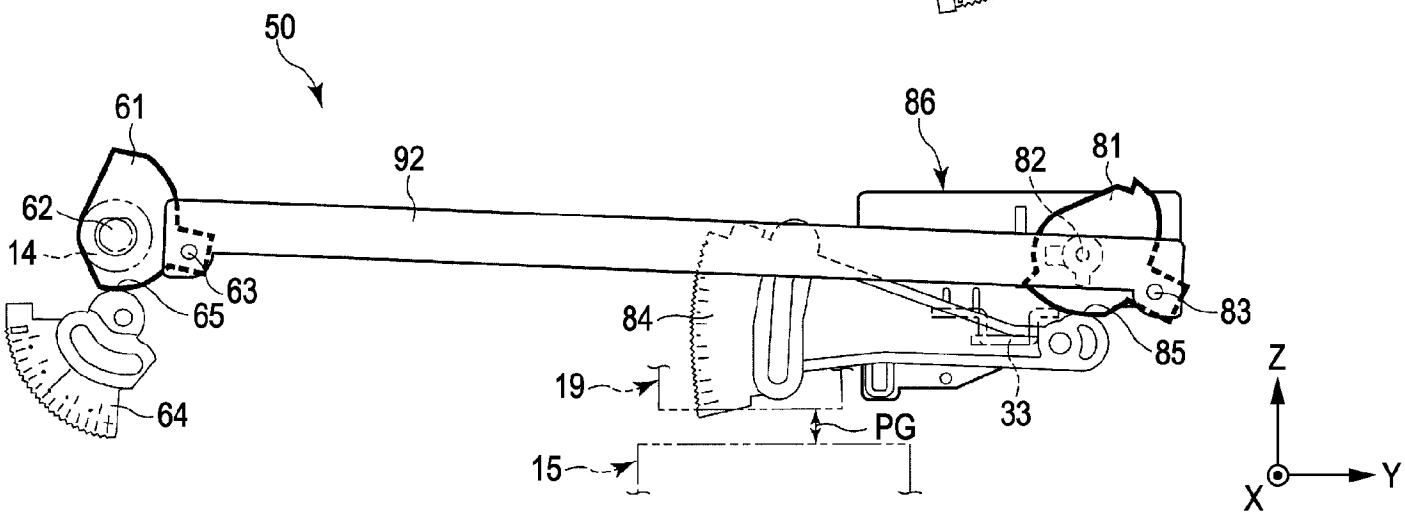

FIG. 3 is a side view that schematically illustrates an example of the configuration of the recording unit of an image formation apparatus according to an exemplary embodiment of the invention. FIG. 4 is a perspective view that schematically illustrates an example of the configuration of a platen gap adjustment unit of an image formation apparatus according to an exemplary embodiment of the invention. The term "platen gap" may be hereafter abbreviated as "PG", or the abbreviation "PG" may be used as a reference symbol for "platen gap". FIGS. 5A and 5B are a set of side views that schematically illustrates an example of the positional state of the PG adjustment unit when it is in a first position. Specifically, FIG. 5A is a side view taken from the 1st digit side in the width direction. FIG. 5B is a side view taken from the 80th digit side in the width direction. In the description of this specification, the term "the first position" means the position of each member when the platen gap PG takes the minimum value.

Figure 10:
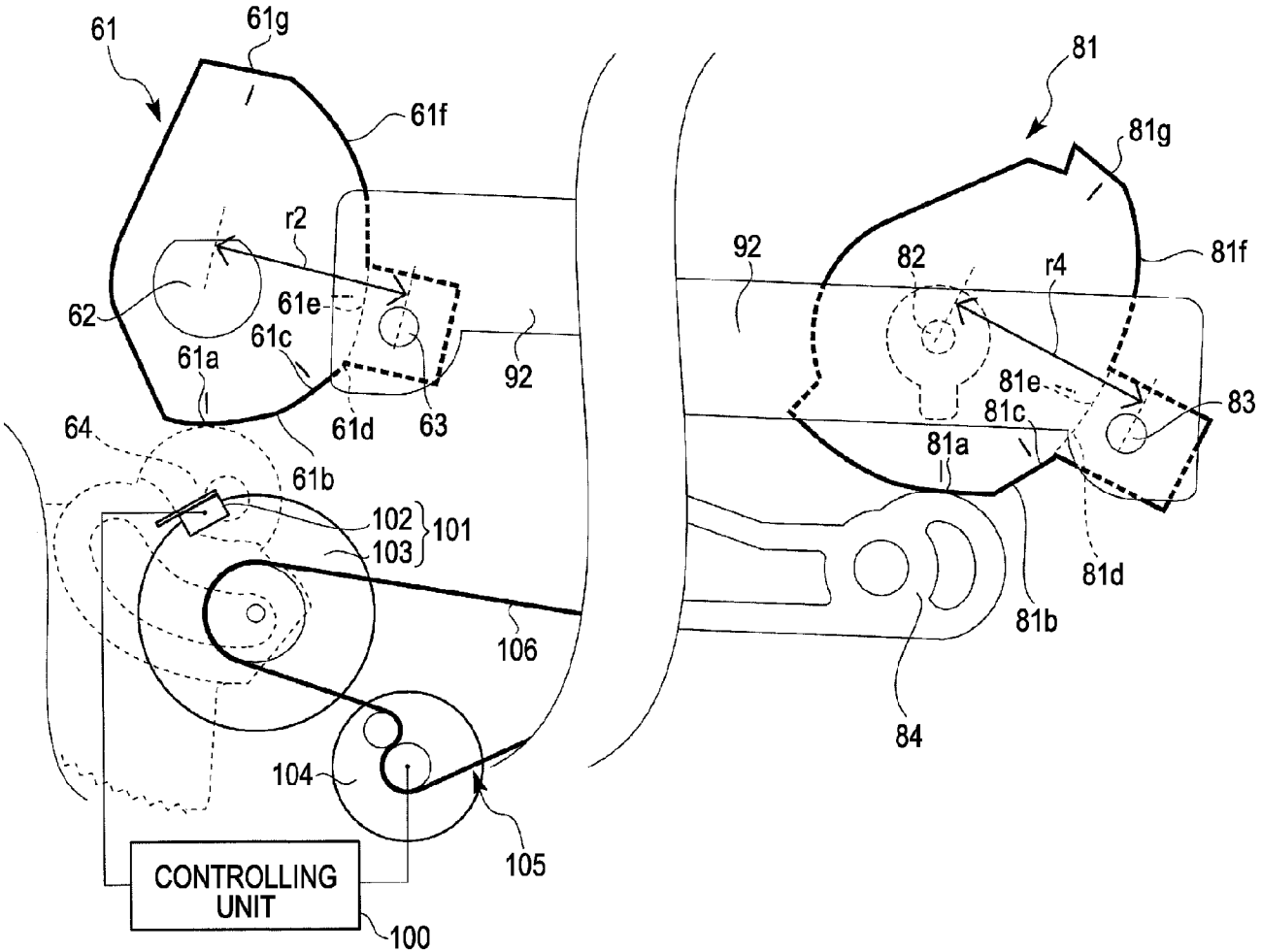
FIG. 10 is a side view that schematically illustrates an example of the radius of a second link connection part of a second cam according to an exemplary embodiment of the invention and an example of the radius of a fourth link connection part of a fourth cam according to an exemplary embodiment of the invention.

As illustrated in FIGS. 3, 4, 5A, and 5B, the recording unit 40 is provided with a PG adjustment unit 50. The PG adjustment unit 50 adjusts a platen gap PG, which is a distance between the recording head 19 and the platen 15. The PG adjustment unit 50 includes a first cam 51, a second cam 61, a third cam 71, a fourth cam 81, a first slider 76, and a second slider 86. The first cam 51 is provided at the 1st digit end of the main guiding shaft 14. The first cam 51 is in engagement with a concentric first support shaft 52, which is provided at the 1st digit end of the main guiding shaft 14. The first cam 51 rotates together with the main guiding shaft 14 around the axial center of the first support shaft 52. The power of a PG adjustment motor 104, which is illustrated in FIG. 10, is transmitted to a power transmission mechanism 105 that includes a first gear 56, a second gear 58, and the like. Specifically, the power of the PG adjustment motor 104 is first transmitted to the first gear 56 of the power transmission mechanism 105. The motor power is then transmitted from the first gear 56 to the second gear 58.

The second gear 58 and the first cam 51 are formed as the same single integrated member. With such a structure, it is possible to rotate the first cam 51 through the power of the PG adjustment motor 104 transmitted thereto.

A part of the circumferential surface of the first cam 51 is in contact with a first adjuster 54, which is provided at the base-member side, at a first reference point 55. The circumferential surface of a cam is hereafter referred to as "cam surface". Specifically, a first stable part 51*a* (refer to FIG. 9) that is formed as a part of the cam surface of the first cam 51 and constitutes a first position that is the same-radius location centering on the first support shaft 52 is in contact with the first adjuster 54 at the first reference point 55.

Each end of the main guiding shaft 14 is supported by a guiding part of the base member 21 in such a manner that the end is allowed to move in the Z-axis direction only. Note that the guiding part of the base member 21 is not illustrated in the drawing. With such a structure, the 1st digit end of the main guiding shaft 14 changes its position in the Z direction as the first cam 51 rotates. The first adjuster 54 is provided so as to slightly change the position of the first reference point 55 at which the first adjuster 54 is in contact with the first cam 51 in the Z direction as it turns. By this means, it is possible to fine adjust the position thereof.

The second cam 61 is provided at the 80th digit end of the main guiding shaft 14. The second cam 61 is in engagement with a concentric second support shaft 62, which is provided at the 80th digit end of the main guiding shaft 14. The second cam 61 rotates together with the main guiding shaft 14 around the axial center of the second support shaft 62. With such a structure, it is possible to rotate the second cam 61 through the power of the PG adjustment motor 104 transmitted thereto via the second gear 58 and the main guiding shaft 14.

A part of the cam surface of the second cam 61 is in contact with a second adjuster 64, which is provided at the base-member side, at a second reference point 65. Specifically, a second stable part 61*a* (refer to FIG. 10) that is formed as a part of the cam surface of the second cam 61 and constitutes a first position that is the same-radius location centering on the second support shaft 62 is in contact with the second adjuster 64 at the second reference point 65.

As explained above, each end of the main guiding shaft 14 is supported by a non-illustrated guiding part of the base member 21 in such a manner that the end is allowed to move in the Z-axis direction only. With such a structure, the 80th digit end of the main guiding shaft 14 changes its position in the Z direction as the second cam 61 rotates. The second adjuster 64 is provided so as to slightly change the position of the second reference point 65 at which the second adjuster 64 is in contact with the second cam 61 in the Z direction as it turns. By this means, it is possible to fine adjust the position thereof.

The third cam 71 is provided at the 1st digit end of the guide rail unit 33. The third cam 71 is in engagement with a third support shaft 72, which is provided on the first slider 76. The third cam 71 rotates around the axial center of the third support shaft 72. A first link connection bar 91 is provided so as to connect a first link connection part 53 of the first cam 51 and a third link connection part 73 of the third cam 71 for interlocked operation. The first link connection bar 91 is an example of another component of the power transmission mechanism 105. With such a structure, it is possible to rotate the third cam 71 through the power of the PG adjustment motor 104 transmitted thereto via the first link connection bar 91. A gear train may be used in the power transmission mechanism 105 that transmits the power of the PG adjustment motor 104 to the third cam 71 as a substitute for the first link connection bar 91. In addition, a gear train may be used as a substitute for a second link connection bar 92, which will be explained later.

A part of the cam surface of the third cam 71 is in contact with a third adjuster 74, which is provided at the base-member side, at a third reference point 75. Specifically, a third stable part 71*a* (refer to FIG. 9) that is formed as a part of the cam surface of the third cam 71 and constitutes a first position that is the same-radius location centering on the third support shaft 72 is in contact with the third adjuster 74 at the third reference point 75.

The first slider 76 is supported by a guiding part of the base member 21 in such a manner that it is allowed to move in the Z-axis direction only. Note that the guiding part of the base member 21 is not illustrated in the drawing. With such a structure, the first slider 76 changes its position in the Z direction as the third cam 71 rotates. The first slider 76, which is provided at the 1st digit side when viewed in the width direction, supports the 1st digit end of the guide rail unit 33. On the other hand, the second slider 86, which is provided at the 80th digit side when viewed in the width direction, supports the 80th digit end of the guide rail unit 33. Therefore, as the first slider 76 changes its position in the Z direction, the Z-axis position of the 1st digit end of the guide rail unit 33 also changes together with the first slider 76. The third adjuster 74 is provided so as to slightly change the position of the third reference point 75 at which the third adjuster 74 is in contact with the third cam 71 in the Z direction as it turns. By this means, it is possible to fine adjust the position thereof.

The fourth cam 81 is provided at the 80th digit end of the guide rail unit 33. The fourth cam 81 is in engagement with a fourth support shaft 82, which is provided on the second slider 86. The fourth cam 81 rotates around the axial center of the fourth support shaft 82. The aforementioned second link connection bar 92 is provided so as to connect a second link connection part 63 of the second cam 61 and a fourth link connection part 83 of the fourth cam 81 for interlocked operation. The second link connection bar 92 is an example of another component of the power transmission mechanism 105. With such a structure, it is possible to rotate the fourth cam 81 through the power of the PG adjustment motor 104 transmitted thereto via the second link connection bar 92.

A part of the cam surface of the fourth cam 81 is in contact with a fourth adjuster 84, which is provided at the base-member side, at a fourth reference point 85. Specifically, a fourth stable part 81*a* (refer to FIG. 10) that is formed as a part of the cam surface of the fourth cam 81 and constitutes a first position that is the same-radius location centering on the fourth support shaft 82 is in contact with the fourth adjuster 84 at the fourth reference point 85.

The second slider 86 is supported by a guiding part of the base member 21 in such a manner that it is allowed to move in the Z-axis direction only, which is the same Z-guiding structure as that of the first-slider guiding part explained above. With such a structure, the second slider 86 changes its position in the Z direction as the fourth cam 81 rotates. As explained earlier, the second slider 86, which is provided at the 80th digit side when viewed in the width direction, supports the 80th digit end of the guide rail unit 33. Therefore, as the second slider 86 changes its position in the Z direction, the Z-axis position of the 80th digit end of the guide rail unit 33 also changes together with the second slider 86. The fourth adjuster 84 is provided so as to slightly change the position of the fourth reference point 85 at which the fourth adjuster 84 is in contact with the fourth cam 81 in the Z direction as it turns. By this means, it is possible to fine adjust the position thereof.

Each of the first adjuster 54, the second adjuster 64, the third adjuster 74, and the fourth adjuster 84 is used for adjustment before the shipment of the printer 11, though not limited thereto. When a PG switchover is performed, these adjusters 54, 64, 74 and 84 are fixed. A gear projection 57 that is formed on the first gear 56 or as a part of the first gear 56 is in contact with a first bump contact part 22, which is provided at the base-member side, when each member is in the first position. Therefore, it is possible to determine the position and the orientation of each member in "the first position" with high precision.

Figure 6A:
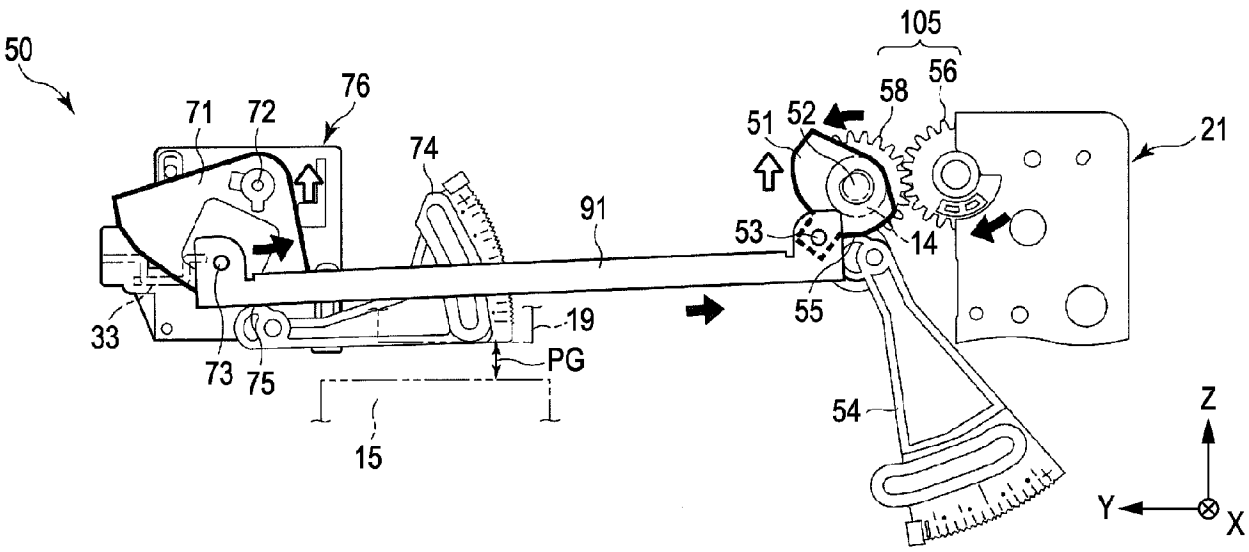
FIGS. 6A and 6B are a set of side views that schematically illustrates an example of the positional state of the PG adjustment unit when it is in a second position.
Figure 6B:
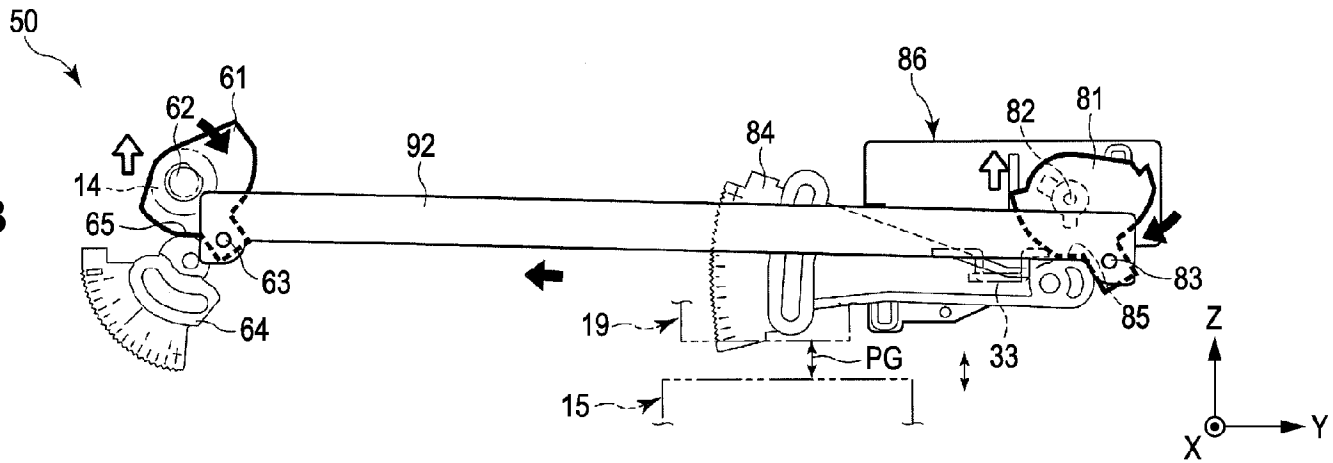

FIGS. 6A and 6B are a set of side views that schematically illustrates an example of the positional state of the PG adjustment unit when it is in a second position. Specifically, FIG. 6A is a side view taken from the 1st digit side in the width direction. FIG. 6B is a side view taken from the 80th digit side in the width direction. In the description of this specification, the term "the second position" means the position of each member when the platen gap PG takes the second smallest value.

As illustrated in FIGS. 6A and 6B, as the PG adjustment motor 104 is driven in the direction of normal motor rotation from a certain motor position corresponding to the first position, the first gear 56 rotates slightly in a clockwise direction illustrated in FIG. 6A. Accordingly, the second gear 58 rotates slightly in a counterclockwise direction illustrated in FIG. 6A due to the clockwise rotation of the first gear 56.

As explained earlier, the first cam 51 and the second gear 58 are formed as the same single integrated member.

Therefore, as the second gear 58 rotates slightly in the counterclockwise direction, so does the first cam 51. The first cam 51 is in engagement with the first support shaft 52 as explained earlier. First working parts 51*b*, 51*d*, and 51*f*, each of which is a force application part, are formed each as a part of the cam surface of the first cam 51. The first working parts 51*b*, 51*d*, and 51*f* are de-centered with respect to the axial center of the first support shaft 52, that is, eccentric with respect thereto. Therefore, while rotating the main guiding shaft 14 slightly in the counterclockwise direction illustrated in FIG. 6A, which is shown by a filled arrow in the drawing, the first cam 51 can push up the main guiding shaft 14 in the positive Z-axis direction, which is shown as the forward direction by an unfilled arrow in the drawing, so as to change the Z position of the main guiding shaft 14, with a part of the cam surface of the first cam 51 being in contact with the first adjuster 54 at the first reference point 55.

Figure 9:
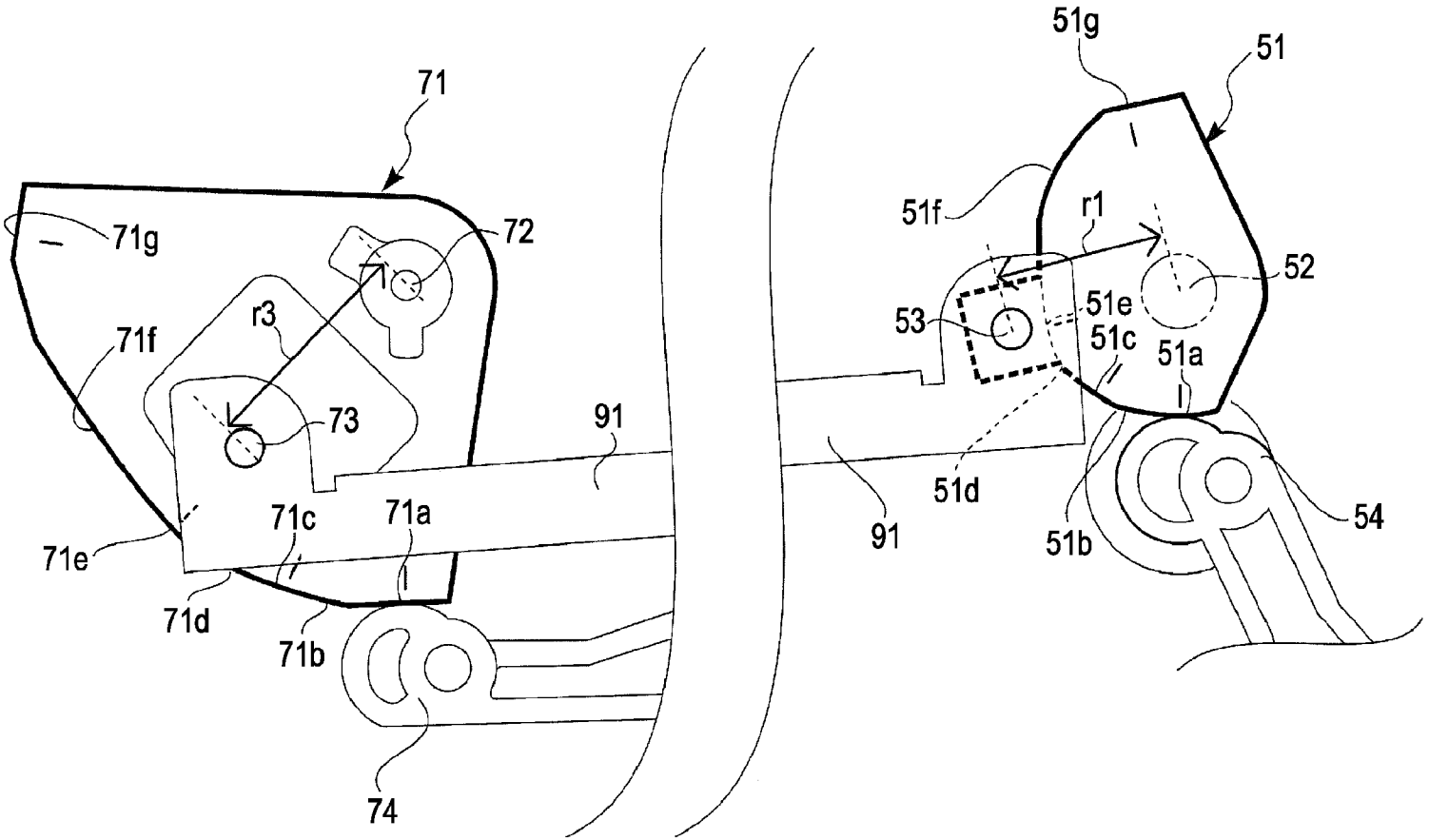
FIG. 9 is a side view that schematically illustrates an example of the radius of a first link connection part of a first cam according to an exemplary embodiment of the invention and an example of the radius of a third link connection part of a third cam according to an exemplary embodiment of the invention.

As illustrated in FIG. 9, the first working part 51*b* is formed as a force application part of the cam surface of the first cam 51 between the first position and the second position. The first working part 51*b* is inclined with respect to the direction of the rotation of the first cam 51. In addition, a first stable part 51*c*, which is illustrated in FIG. 9, is formed as a part of the cam surface of the first cam 51 so as to constitute the second position that is the same-radius location centering on the first support shaft 52. The first stable part 51*c* that constitutes the second position is larger in radius (or diameter) than the first stable part 51*a* that constitutes the first position. As the first cam 51 rotates, the first working part 51*b* that is formed between the first position and the second position is brought into contact with the first adjuster 54 and pushes up the main guiding shaft 14 in the forward Z-axis direction shown by the white arrow so as to change the Z position of the main guiding shaft 14. Thereafter, the first stable part 51*c* (refer to FIG. 9) that constitutes the second position is brought into contact with the first adjuster 54 at the first reference point 55.

As explained earlier, the second cam 61 rotates through the motor power transmitted thereto via the main guiding shaft 14 when the first cam 51 rotates. Accordingly, when the first cam 51 rotates slightly in the counterclockwise direction shown in FIG. 6A, the second cam 61 rotates slightly in the clockwise direction shown in FIG. 6B. The second cam 61 is in engagement with the second support shaft 62 as explained earlier. Second working parts 61*b*, 61*d*, and 61*f*, each of which is a force application part, are formed each as a part of the cam surface of the second cam 61. The second working parts 61*b*, 61*d*, and 61*f* are de-centered with respect to the axial center of the second support shaft 62, that is, eccentric with respect thereto. Therefore, while turning together with the main guiding shaft 14 slightly in the clockwise direction illustrated in FIG. 6B, which is shown by a filled arrow in the drawing, the second cam 61 can push up the main guiding shaft 14 in the forward Z-axis direction, which is shown by an unfilled arrow in the drawing, so as to change the Z position of the main guiding shaft 14, with a part of the cam surface of the second cam 61 being in contact with the second adjuster 64 at the second reference point 65.

As illustrated in FIG. 10, the second working part 61*b* is formed as a force application part of the cam surface of the second cam 61 between the first position and the second position. The second working part 61*b* is inclined with respect to the direction of the rotation of the second cam 61. In addition, a second stable part 61*c*, which is illustrated in FIG. 10, is formed as a part of the cam surface of the second cam 61 so as to constitute the second position that is the same-radius location centering on the second support shaft 62. The second stable part 61*c* that constitutes the second position is larger in radius than the second stable part 61*a* that constitutes the first position. As the second cam 61 rotates, the second working part 61*b* that is formed between the first position and the second position is brought into contact with the second adjuster 64 and pushes up the main guiding shaft 14 in the forward Z-axis direction shown by the white arrow so as to change the Z position of the main guiding shaft 14. Thereafter, the second stable part 61*c* (refer to FIG. 10) that constitutes the second position is brought into contact with the second adjuster 64 at the second reference point 65.

As explained earlier, the third cam 71 rotates through the motor power transmitted thereto due to the operation of the first link connection bar 91 when the first cam 51 rotates. Accordingly, when the first cam 51 rotates slightly in the counterclockwise direction shown in FIG. 6A, the third cam 71 also rotates slightly in the counterclockwise direction shown in the same drawing. The third cam 71 is in engagement with the third support shaft 72 as explained earlier. Third working parts 71*b*, 71*d*, and 71*f*, each of which is a force application part, are formed each as a part of the cam surface of the third cam 71. The third working parts 71*b*, 71*d*, and 71*f* are de-centered with respect to the axial center of the third support shaft 72, that is, eccentric with respect thereto. Therefore, while turning slightly in the counterclockwise direction illustrated in FIG. 6A, which is shown by a filled arrow in the drawing, the third cam 71 can push up the first slider 76 in the forward Z-axis direction, which is shown by an unfilled arrow in the drawing, so as to change the Z position of the first slider 76, with a part of the cam surface of the third cam 71 being in contact with the third adjuster 74 at the third reference point 75. As explained earlier, the first slider 76, which is provided at the 1st digit side when viewed in the width direction, supports the 1st digit end of the guide rail unit 33. Therefore, the third cam 71 can change the position of the 1st digit end of the guide rail unit 33 together with the first slider 76 in the forward Z-axis direction, which is shown by the unfilled arrow in the drawing.

As illustrated in FIG. 9, the third working part 71*b* is formed as a force application part of the cam surface of the third cam 71 between the first position and the second position. The third working part 71*b* is inclined with respect to the direction of the rotation of the third cam 71. In addition, a third stable part 71*c*, which is illustrated in FIG. 9, is formed as a part of the cam surface of the third cam 71 so as to constitute the second position that is the same-radius location centering on the third support shaft 72. The third stable part 71*c* that constitutes the second position is larger in radius than the third stable part 71*a* that constitutes the first position. As the third cam 71 rotates, the third working part 71*b* that is formed between the first position and the second position is brought into contact with the third adjuster 74 and pushes up the guide rail unit 33 in the forward Z-axis direction shown by the white arrow so as to change the Z position of the guide rail unit 33. Thereafter, the third stable part 71*c* (refer to FIG. 9) that constitutes the second position is brought into contact with the third adjuster 74 at the third reference point 75.

As explained earlier, the fourth cam 81 rotates through the motor power transmitted thereto due to the operation of the second link connection bar 92 when the second cam 61 rotates. Accordingly, when the second cam 61 rotates slightly in the clockwise direction shown in FIG. 6B, the fourth cam 81 also rotates slightly in the clockwise direction shown in the same drawing. The fourth cam 81 is in engagement with the fourth support shaft 82 as explained earlier. Fourth working parts 81*b*, 81*d*, and 81*f*, each of which is a force application part, are formed each as a part of the cam surface of the fourth cam 81. The fourth working parts 81*b*, 81*d*, and 81*f* are de-centered with respect to the axial center of the fourth support shaft 82, that is, eccentric with respect thereto. Therefore, while turning slightly in the clockwise direction illustrated in FIG. 6B, which is shown by a filled arrow in the drawing, the fourth cam 81 can push up the second slider 86 in the forward Z-axis direction, which is shown by an unfilled arrow in the drawing, so as to change the Z position of the second slider 86, with a part of the cam surface of the fourth cam 81 being in contact with the fourth adjuster 84 at the fourth reference point 85. As explained earlier, the second slider 86, which is provided at the 80th digit side when viewed in the width direction, supports the 80th digit end of the guide rail unit 33. Therefore, the fourth cam 81 can change the position of the 80th digit end of the guide rail unit 33 together with the second slider 86 in the forward Z-axis direction, which is shown by the unfilled arrow in the drawing.

As illustrated in FIG. 10, the fourth working part 81*b* is formed as a force application part of the cam surface of the fourth cam 81 between the first position and the second position. The fourth working part 81*b* is inclined with respect to the direction of the rotation of the fourth cam 81. In addition, a fourth stable part 81*c*, which is illustrated in FIG. 10, is formed as a part of the cam surface of the fourth cam 81 so as to constitute the second position that is the same-radius location centering on the fourth support shaft 82. The fourth stable part 81*c* that constitutes the second position is larger in radius than the fourth stable part 81*a* that constitutes the first position. As the fourth cam 81 rotates, the fourth working part 81*b* that is formed between the first position and the second position is brought into contact with the fourth adjuster 84 and pushes up the guide rail unit 33 in the forward Z-axis direction shown by the white arrow so as to change the Z position of the guide rail unit 33. Thereafter, the fourth stable part 81*c* (refer to FIG. 10) that constitutes the second position is brought into contact with the fourth adjuster 84 at the fourth reference point 85.

As explained above, it is possible to change the position of the main guiding shaft 14 and the position of the guide rail unit 33 in the forward Z-axis direction, which is shown by the white arrow in the drawing. When the main guiding shaft 14 and the guide rail unit 33 are pushed up, the amount of change in the position of the main guiding shaft 14, that is, a main shaft Z-shift distance, is the same as the amount of change in the position of the guide rail unit 33, that is, a rail Z-shift distance. That is, it is possible to easily change the position of the guide rail unit 33 in the Z-axis direction in interlock with the main guiding shaft 14, which rotates in the axial direction around the axial center thereof. Such an interlocked configuration is especially useful in a case where it is not possible to rotate the guide rail unit 33 in the axial direction around the axial center thereof. For example, as in the illustrated structure of the guide rail unit 33 according to the present embodiment of the invention, the guide rail unit 33 may be made of a sheet metal member and thus not as a rotatable shaft, a rotatable columnar member, or the like. As a result of the operation explained above, it is possible to set the platen gap PG into the second position, which is the position of each member when the platen gap PG takes the second smallest value as defined above.

Figure 7A:
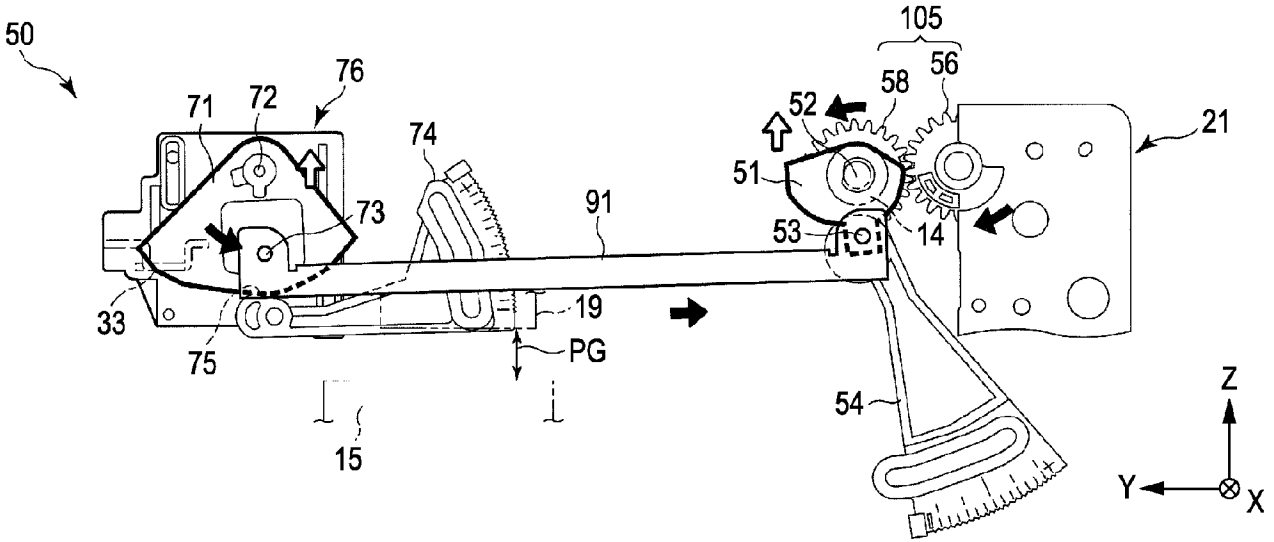
FIGS. 7A and 7B are a set of side views that schematically illustrates an example of the positional state of the PG adjustment unit when it is in a third position.
Figure 7B:
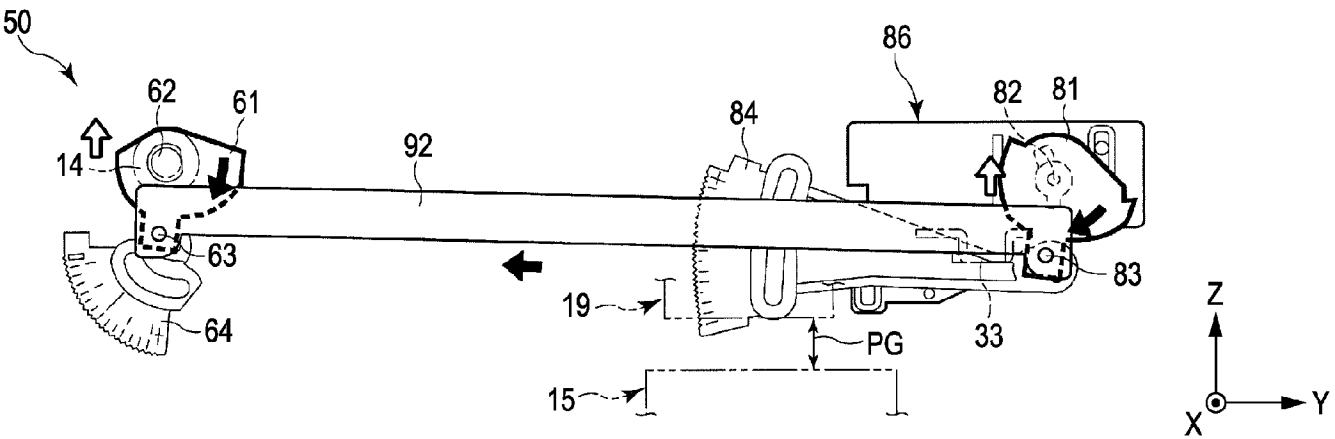

FIGS. 7A and 7B are a set of side views that schematically illustrates an example of the positional state of the PG adjustment unit when it is in a third position. Specifically, FIG. 7A is a side view taken from the 1st digit side in the width direction. FIG. 7B is a side view taken from the 80th digit side in the width direction. In the description of this specification, the term "the third position" means the position of each member when the platen gap PG takes the third smallest value.

As illustrated in FIGS. 7A and 7B, as the PG adjustment motor 104 is further driven in the direction of normal motor rotation from a certain motor position corresponding to the second position, the second gear 58 further rotates slightly in a counterclockwise direction illustrated in FIG. 7A from the gear state (i.e., gear position) illustrated in FIG. 6A. As the second gear 58 further rotates slightly in the counterclockwise direction, the first cam 51 also rotates slightly in the counterclockwise direction from the cam state illustrated in FIG. 6A. As a result, while rotating the main guiding shaft 14 slightly in the counterclockwise direction illustrated in FIG. 7A, which is shown by a filled arrow in the drawing, the first cam 51 can further push up the main guiding shaft 14 in the forward Z-axis direction, which is shown by an unfilled arrow in the drawing, so as to change the Z position of the main guiding shaft 14 from the shaft position illustrated in FIG. 6A, with a part of the cam surface of the first cam 51 being in contact with the first adjuster 54 at the first reference point 55.

As illustrated in FIG. 9, the first working part 51*d* is formed as a force application part of the cam surface of the first cam 51 between the second position and the third position. The first working part 51*d* is inclined with respect to the direction of the rotation of the first cam 51. In addition, a first stable part 51*e*, which is illustrated in FIG. 9, is formed as a part of the cam surface of the first cam 51 so as to constitute the third position that is the same-radius location centering on the first support shaft 52. The first stable part 51*e* that constitutes the third position is larger in radius than the first stable part 51*c* that constitutes the second position. As the first cam 51 rotates, the first working part 51*d* that is formed between the second position and the third position is brought into contact with the first adjuster 54 and further pushes up the main guiding shaft 14 in the forward Z-axis direction shown by the white arrow so as to change the Z position of the main guiding shaft 14. Thereafter, the first stable part 51*e* (refer to FIG. 9) that constitutes the third position is brought into contact with the first adjuster 54 at the first reference point 55.

When the first cam 51 further rotates slightly in the counterclockwise direction shown in FIG. 7A, the second cam 61 further rotates slightly in the clockwise direction shown in FIG. 7B from the cam state shown in FIG. 6B. As a result, while turning together with the main guiding shaft 14 slightly in the clockwise direction illustrated in FIG. 7B, which is shown by a filled arrow in the drawing, the second cam 61 can further push up the main guiding shaft 14 in the forward Z-axis direction, which is shown by an unfilled arrow in the drawing, so as to change the Z position of the main guiding shaft 14 from the shaft position illustrated in FIG. 6B, with a part of the cam surface of the second cam 61 being in contact with the second adjuster 64 at the second reference point 65.

As illustrated in FIG. 10, the second working part 61*d* is formed as a force application part of the cam surface of the second cam 61 between the second position and the third position. The second working part 61*d* is inclined with respect to the direction of the rotation of the second cam 61. In addition, a second stable part 61*e*, which is illustrated in FIG. 10, is formed as a part of the cam surface of the second cam 61 so as to constitute the third position that is the same-radius location centering on the second support shaft 62. The second stable part 61*e* that constitutes the third position is larger in radius than the second stable part 61*c* that constitutes the second position. As the second cam 61 rotates, the second working part 61*d* that is formed between the second position and the third position is brought into contact with the second adjuster 64 and further pushes up the main guiding shaft 14 in the forward Z-axis direction shown by the white arrow so as to change the Z position of the main guiding shaft 14. Thereafter, the second stable part 61*e* (refer to FIG. 10) that constitutes the third position is brought into contact with the second adjuster 64 at the second reference point 65.

When the first cam 51 further rotates slightly in the counterclockwise direction shown in FIG. 7A, the third cam 71 also further rotates slightly in the counterclockwise direction shown in the same drawing from the cam state shown in FIG. 6A. As a result, while turning slightly in the counterclockwise direction illustrated in FIG. 7A, which is shown by a filled arrow in the drawing, the third cam 71 can further push up the 1st digit end of the guide rail unit 33 together with the first slider 76 in the forward Z-axis direction, which is shown by an unfilled arrow in the drawing, so as to change the Z position of the 1st digit end of the guide rail unit 33 and the first slider 76 from the rail/slider position illustrated in FIG. 6A, with a part of the cam surface of the third cam 71 being in contact with the third adjuster 74 at the third reference point 75.

As illustrated in FIG. 9, the third working part 71*d* is formed as a force application part of the cam surface of the third cam 71 between the second position and the third position. The third working part 71*d* is inclined with respect to the direction of the rotation of the third cam 71. In addition, a third stable part 71*e*, which is illustrated in FIG. 9, is formed as a part of the cam surface of the third cam 71 so as to constitute the third position that is the same-radius location centering on the third support shaft 72. The third stable part 71*e* that constitutes the third position is larger in radius than the third stable part 71*c* that constitutes the second position. As the third cam 71 rotates, the third working part 71*d* that is formed between the second position and the third position is brought into contact with the third adjuster 74 and further pushes up the guide rail unit 33 in the forward Z-axis direction shown by the white arrow so as to change the Z position of the guide rail unit 33. Thereafter, the third stable part 71*e* (refer to FIG. 9) that constitutes the third position is brought into contact with the third adjuster 74 at the third reference point 75.

When the second cam 61 rotates slightly in the clockwise direction shown in FIG. 7B, the fourth cam 81 also rotates slightly in the clockwise direction shown in the same drawing. As a result, while turning slightly in the clockwise direction illustrated in FIG. 7B, which is shown by a filled arrow in the drawing, the fourth cam 81 can further push up the 80th digit end of the guide rail unit 33 together with the second slider 86 in the forward Z-axis direction, which is shown by an unfilled arrow in the drawing, so as to change the Z position of the 80th digit end of the guide rail unit 33 and the second slider 86 from the rail/slider position illustrated in FIG. 6B, with a part of the cam surface of the fourth cam 81 being in contact with the fourth adjuster 84 at the fourth reference point 85.

As illustrated in FIG. 10, the fourth working part 81*d* is formed as a force application part of the cam surface of the fourth cam 81 between the second position and the third position. The fourth working part 81*d* is inclined with respect to the direction of the rotation of the fourth cam 81. In addition, a fourth stable part 81*e*, which is illustrated in FIG. 10, is formed as a part of the cam surface of the fourth cam 81 so as to constitute the third position that is the same-radius location centering on the fourth support shaft 82. The fourth stable part 81*e* that constitutes the third position is larger in radius than the fourth stable part 81*c* that constitutes the second position. As the fourth cam 81 rotates, the fourth working part 81*d* that is formed between the second position and the third position is brought into contact with the fourth adjuster 84 and further pushes up the guide rail unit 33 in the forward Z-axis direction shown by the white arrow so as to change the Z position of the guide rail unit 33. Thereafter, the fourth stable part 81*e* (refer to FIG. 10) that constitutes the third position is brought into contact with the fourth adjuster 84 at the fourth reference point 85.

As explained above, it is possible to further change the position of the main guiding shaft 14 and the position of the guide rail unit 33 from the shaft position and the rail position illustrated in FIGS. 6A and 6B in the forward Z-axis direction, which is shown by the white arrow in the drawing. When the main guiding shaft 14 and the guide rail unit 33 are further pushed up, the amount of change in the position of the main guiding shaft 14 is the same as the amount of change in the position of the guide rail unit 33. As a result of the operation explained above, it is possible to set the platen gap PG into the third position, which is the position of each member when the platen gap PG takes the third smallest value as defined above.

Figure 8A:
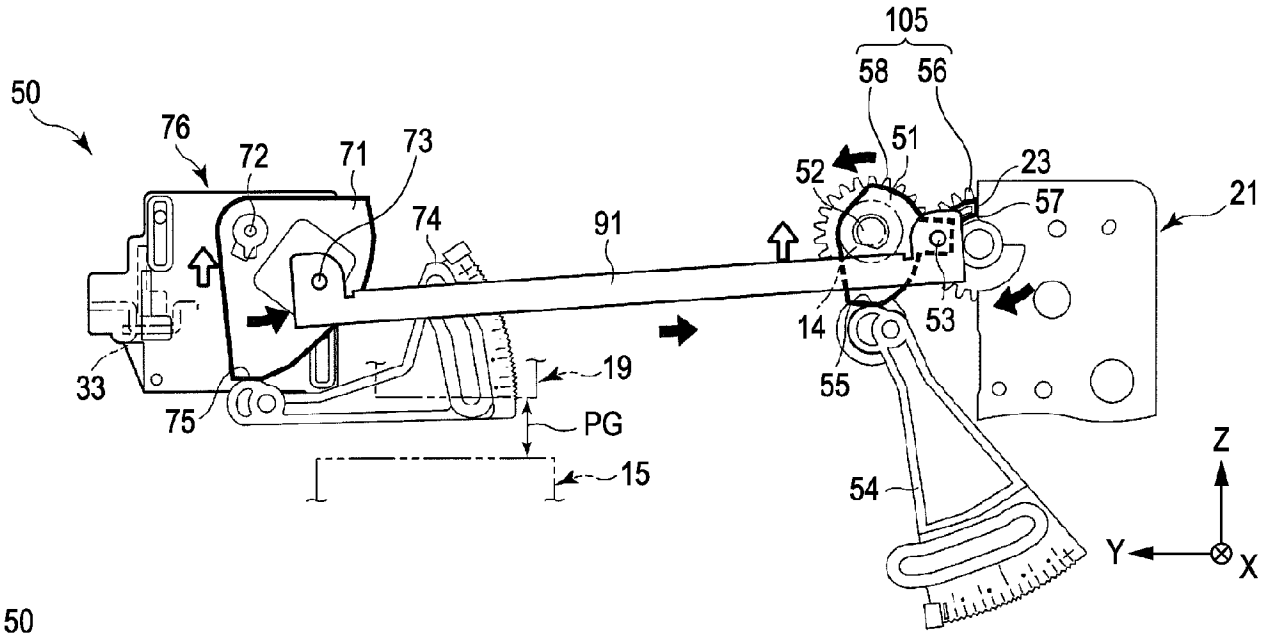
FIGS. 8A and 8B are a set of side views that schematically illustrates an example of the positional state of the PG adjustment unit when it is in a fourth position.
Figure 8B:
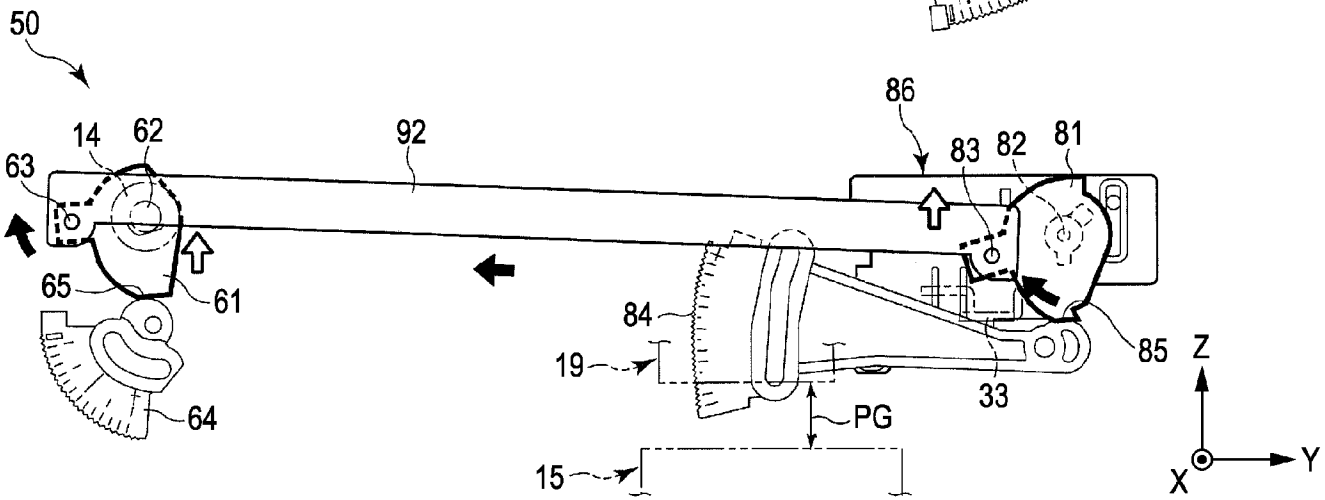

FIGS. 8A and 8B are a set of side views that schematically illustrates an example of the positional state of the PG adjustment unit when it is in a fourth position. Specifically, FIG. 8A is a side view taken from the 1st digit side in the width direction. FIG. 8B is a side view taken from the 80th digit side in the width direction. In the description of this specification, the term "the fourth position" means the position of each member when the platen gap PG takes the maximum value.

As illustrated in FIGS. 8A and 8B, as the PG adjustment motor 104 is further driven in the direction of normal motor rotation from a certain motor position corresponding to the third position, the first gear 56 further rotates slightly in a clockwise direction illustrated in FIG. 8A from the gear state illustrated in FIG. 7A. The gear projection 57 is brought into contact with a second bump contact part 23, which is provided on the base member 21. Therefore, it is possible to determine the phase of the first gear 56 with high precision. The second gear 58 further rotates slightly in a counterclockwise direction illustrated in FIG. 8A from the gear position illustrated in FIG. 7A due to the clockwise rotation of the first gear 56. As the second gear 58 further rotates slightly in the counterclockwise direction, the first cam 51 also rotates slightly in the counterclockwise direction from the cam state illustrated in FIG. 7A. As a result, while rotating the main guiding shaft 14 slightly in the counterclockwise direction illustrated in FIG. 8A, which is shown by a filled arrow in the drawing, the first cam 51 can further push up the main guiding shaft 14 in the forward Z-axis direction, which is shown by an unfilled arrow in the drawing, so as to change the Z position of the main guiding shaft 14 from the shaft position illustrated in FIG. 7A, with a part of the cam surface of the first cam 51 being in contact with the first adjuster 54 at the first reference point 55.

As illustrated in FIG. 9, the first working part 51*f* is formed as a force application part of the cam surface of the first cam 51 between the third position and the fourth position. The first working part 51*f* is inclined with respect to the direction of the rotation of the first cam 51. In addition, a first stable part 51*g*, which is illustrated in FIG. 9, is formed as a part of the cam surface of the first cam 51 so as to constitute the fourth position that is the same-radius location centering on the first support shaft 52. The first stable part 51*g* that constitutes the fourth position is larger in radius than the first stable part 51*e* that constitutes the third position. As the first cam 51 rotates, the first working part 51*f* that is formed between the third position and the fourth position is brought into contact with the first adjuster 54 and further pushes up the main guiding shaft 14 in the forward Z-axis direction shown by the white arrow so as to change the Z position of the main guiding shaft 14. Thereafter, the first stable part 51*g* (refer to FIG. 9) that constitutes the fourth position is brought into contact with the first adjuster 54 at the first reference point 55.

When the first cam 51 further rotates slightly in the counterclockwise direction shown in FIG. 8A, the second cam 61 further rotates slightly in the clockwise direction shown in FIG. 8B from the cam state shown in FIG. 7B. As a result, while turning together with the main guiding shaft 14 slightly in the clockwise direction illustrated in FIG. 8B, which is shown by a filled arrow in the drawing, the second cam 61 can further push up the main guiding shaft 14 in the forward Z-axis direction, which is shown by an unfilled arrow in the drawing, so as to change the Z position of the main guiding shaft 14 from the shaft position illustrated in FIG. 7B, with a part of the cam surface of the second cam 61 being in contact with the second adjuster 64 at the second reference point 65.

As illustrated in FIG. 10, the second working part 61*f* is formed as a force application part of the cam surface of the second cam 61 between the third position and the fourth position. The second working part 61*f* is inclined with respect to the direction of the rotation of the second cam 61. In addition, a second stable part 61*g*, which is illustrated in FIG. 10, is formed as a part of the cam surface of the second cam 61 so as to constitute the fourth position that is the same-radius location centering on the second support shaft 62. The second stable part 61*g* that constitutes the fourth position is larger in radius than the second stable part 61*e* that constitutes the third position. As the second cam 61 rotates, the second working part 61*f* that is formed between the third position and the fourth position is brought into contact with the second adjuster 64 and further pushes up the main guiding shaft 14 in the forward Z-axis direction shown by the white arrow so as to change the Z position of the main guiding shaft 14. Thereafter, the second stable part 61*g* (refer to FIG. 10) constituting the fourth position is brought into contact with the second adjuster 64 at the second reference point 65.

When the first cam 51 further rotates slightly in the counterclockwise direction shown in FIG. 8A, the third cam 71 also further rotates slightly in the counterclockwise direction shown in the same drawing from the cam state shown in FIG. 7A. As a result, while turning slightly in the counterclockwise direction illustrated in FIG. 8A, which is shown by a filled arrow in the drawing, the third cam 71 can further push up the 1st digit end of the guide rail unit 33 together with the first slider 76 in the forward Z-axis direction, which is shown by an unfilled arrow in the drawing, so as to change the Z position of the 1st digit end of the guide rail unit 33 and the first slider 76 from the rail/slider position illustrated in FIG. 7A, with a part of the cam surface of the third cam 71 being in contact with the third adjuster 74 at the third reference point 75.

As illustrated in FIG. 9, the third working part 71*f* is formed as a force application part of the cam surface of the third cam 71 between the third position and the fourth position. The third working part 71*f* is inclined with respect to the direction of the rotation of the third cam 71. In addition, a third stable part 71*g*, which is illustrated in FIG. 9, is formed as a part of the cam surface of the third cam 71 so as to constitute the fourth position that is the same-radius location centering on the third support shaft 72. The third stable part 71*g* that constitutes the fourth position is larger in radius than the third stable part 71*e* that constitutes the third position. As the third cam 71 rotates, the third working part 71*f* that is formed between the third position and the fourth position is brought into contact with the third adjuster 74 and further pushes up the guide rail unit 33 in the forward Z-axis direction shown by the white arrow so as to change the Z position of the guide rail unit 33. Thereafter, the third stable part 71*g* (refer to FIG. 9) constituting the fourth position is brought into contact with the third adjuster 74 at the third reference point 75.

When the second cam 61 rotates slightly in the clockwise direction shown in FIG. 8B, the fourth cam 81 also rotates slightly in the clockwise direction shown in the same drawing. As a result, while turning slightly in the clockwise direction illustrated in FIG. 8B, which is shown by a filled arrow in the drawing, the fourth cam 81 can further push up the 80th digit end of the guide rail unit 33 together with the second slider 86 in the forward Z-axis direction, which is shown by an unfilled arrow in the drawing, so as to change the Z position of the 80th digit end of the guide rail unit 33 and the second slider 86 from the rail/slider position illustrated in FIG. 7B, with a part of the cam surface of the fourth cam 81 being in contact with the fourth adjuster 84 at the fourth reference point 85.

As illustrated in FIG. 10, the fourth working part 81*f* is formed as a force application part of the cam surface of the fourth cam 81 between the third position and the fourth position. The fourth working part 81*f* is inclined with respect to the direction of the rotation of the fourth cam 81. In addition, a fourth stable part 81*g*, which is illustrated in FIG. 10, is formed as a part of the cam surface of the fourth cam 81 so as to constitute the fourth position that is the same-radius location centering on the fourth support shaft 82. The fourth stable part 81*g* that constitutes the fourth position is larger in radius than the fourth stable part 81*e* that constitutes the third position. As the fourth cam 81 rotates, the fourth working part 81*f* that is formed between the third position and the fourth position is brought into contact with the fourth adjuster 84 and further pushes up the guide rail unit 33 in the forward Z-axis direction shown by the white arrow so as to change the Z position of the guide rail unit 33. Thereafter, the fourth stable part 81*g* (refer to FIG. 10) constituting the fourth position is brought into contact with the fourth adjuster 84 at the fourth reference point 85.

As explained above, it is possible to further change the position of the main guiding shaft 14 and the position of the guide rail unit 33 from the shaft position and the rail position illustrated in FIGS. 7A and 7B in the forward Z-axis direction, which is shown by the white arrow in the drawing. When the main guiding shaft 14 and the guide rail unit 33 are further pushed up, the amount of change in the position of the main guiding shaft 14 is the same as the amount of change in the position of the guide rail unit 33. As a result of the operation explained above, it is possible to set the platen gap PG into the fourth position, which is the position of each member when the platen gap PG takes the maximum value as defined above.

When the PG position of each member is changed over from the fourth position to any of the first position, the second position, and the third position, the PG adjustment motor 104 is driven in the direction of reverse motor rotation. By this means, it is possible to perform such a reverse position changeover. Needless to say, it is possible to change over the PG position directly from the fourth position to the first position or the second position when making such a reverse position changeover.

FIG. 9 is a side view that schematically illustrates an example of the radius of a first link connection part of a first cam according to an exemplary embodiment of the invention and an example of the radius of a third link connection part of a third cam according to an exemplary embodiment of the invention. FIG. 10 is a side view that schematically illustrates an example of the radius of a second link connection part of a second cam according to an exemplary embodiment of the invention and an example of the radius of a fourth link connection part of a fourth cam according to an exemplary embodiment of the invention. As illustrated in FIG. 9, a third link connection radius of rotation r3, which is a distance between the axial center of the third support shaft 72 and the third link connection part 73 of the third cam 71, is larger than a first link connection radius of rotation r1, which is a distance between the axial center of the first support shaft 52 and the first link connection part 53 of the first cam 51. Each link connection radius of rotation might be hereafter referred to as a link-connection turning radius.

That is, the third link-connection turning radius r3, which can be re-defined as a distance from the fulcrum of the third cam 71 provided at the relatively downstream side when viewed in the direction of the transmission of driving power to the third link connection part 73 thereof, is larger than the first link-connection turning radius r1, which can be re-defined as a distance from the fulcrum of the first cam 51 provided at the relatively upstream side when viewed in the direction of the transmission of driving power to the first link connection part 53 thereof. Because of such a structure, the angular width of rotation of the downstream-side third cam 71, which rotates as pulled by the first link connection bar 91 when the upstream-side first cam 51 rotates, is smaller than that of the first cam 51. Consequently, it is possible to move the third link connection part 73 in a movement range that is distanced from a straight line that connects the axial center of the third support shaft 72 and the axial center of the first support shaft 52, thereby making it further possible to reduce so-called play loss.

That is, it is ensured that the direction of a force that is applied by the first link connection bar 91 to the third link connection part 73 is always within a range from the same direction as the extending direction of the straight line that connects the axial center of the third support shaft 72 and the axial center of the first support shaft 52 to a direction that is inclined slightly with respect thereto. Therefore, it is possible to perform power transmission efficiently. In other words, it is possible to avoid any power transmission loss from occurring due to the orthogonality of the direction of a force that is applied by the first link connection bar 91 to the third link connection part 73 and the extending direction of the straight line that connects the axial center of the third support shaft 72 and the axial center of the first support shaft 52. Thanks to the reduction of loss, it is possible to approximate the linear movement distance of the third link connection part 73 to the linear movement distance of the first link connection part 53 sufficiently, for example, to the greatest approximation level when the first cam 51 rotates. As a consequence thereof, it is possible to approximate the shift amount of the guide rail unit 33 in the Z direction to the shift amount of the main guiding shaft 14 in the Z direction sufficiently because of the reduction of loss. Thus, it is possible to perform a PG switchover with high precision.

As illustrated in FIG. 10, a fourth link-connection turning radius r4, which is a distance between the axial center of the fourth support shaft 82 and the fourth link connection part 83 of the fourth cam 81, is larger than a second link-connection turning radius r2, which is a distance between the axial center of the second support shaft 62 and the second link connection part 63 of the second cam 61. With such a structure, it is possible to reduce play loss and achieve efficient power transmission when transmitting power from the second link connection part 63 of the second cam 61 to the fourth link connection part 83 of the fourth cam 81 by means of the interlock operation of the second link connection bar 92 as done in the power transmission from the first link connection part 53 of the first cam 51 to the third link connection part 73 of the third cam 71 by means of the interlock operation of the first link connection bar 91 explained above. Thus, it is possible to approximate the linear movement distance of the fourth link connection part 83 to the linear movement distance of the second link connection part 63 sufficiently, for example, to the greatest approximation level when the second cam 61 rotates.

Figure 11:
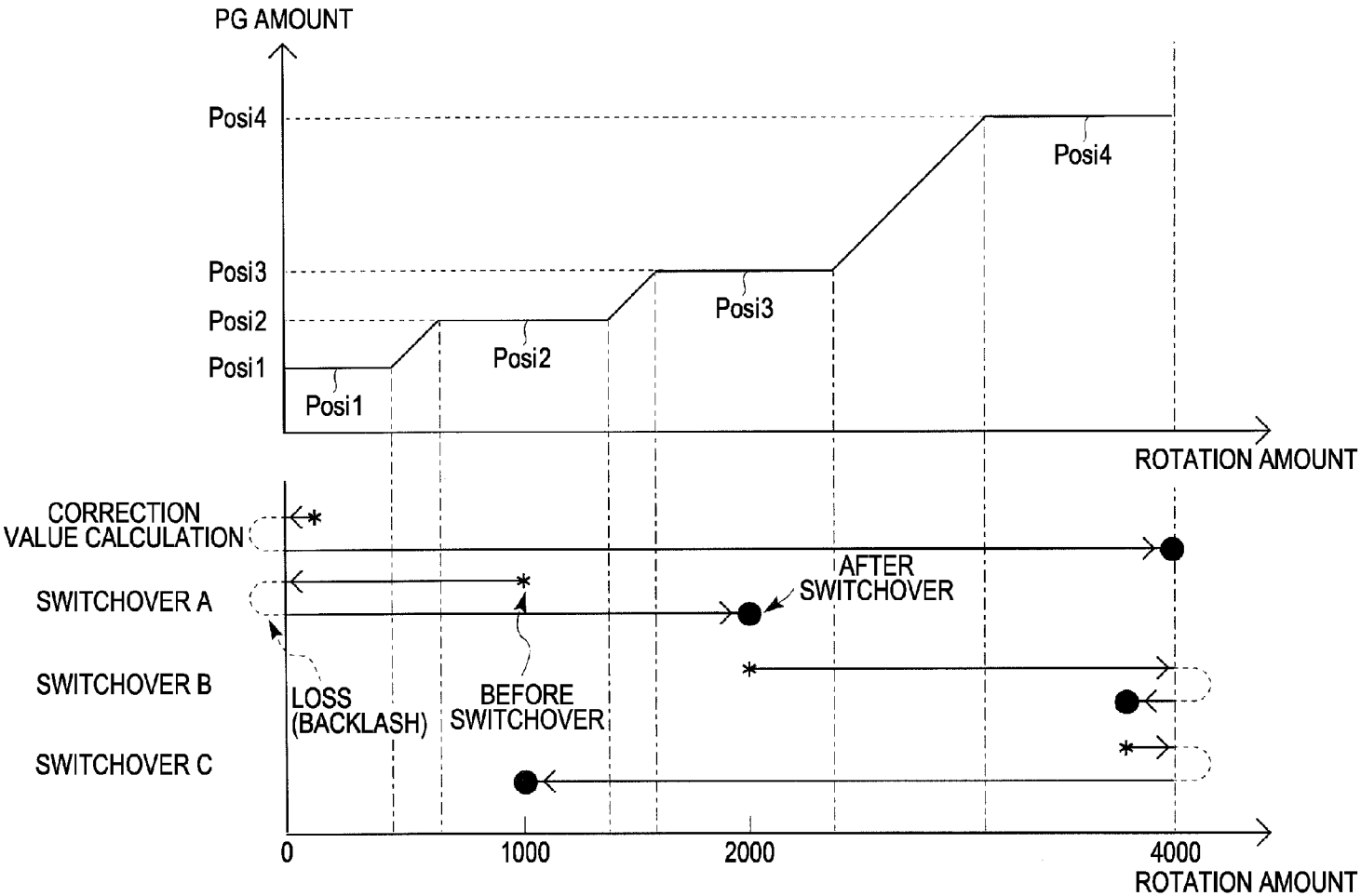
FIG. 11 is a set of diagrams that schematically illustrates an example of the motor operation of a PG adjustment motor when PG changeover operation according to an exemplary embodiment of the invention is performed.
Figure 12:
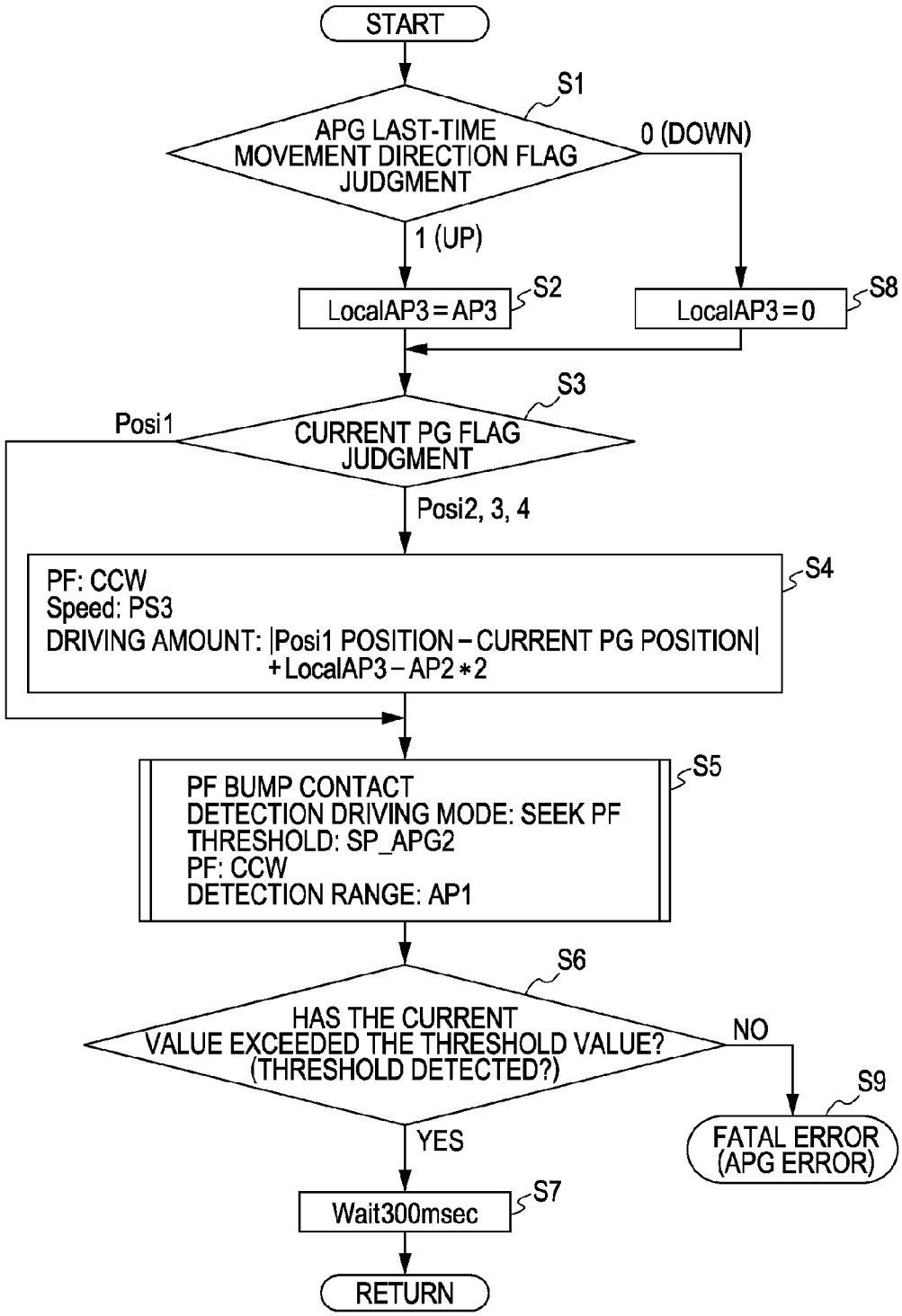
FIG. 12 is a flowchart that schematically illustrates an example of a part of the PG changeover operation according to an exemplary embodiment of the invention.

FIG. 11 is a set of diagrams that schematically illustrates an example of the motor operation of a PG adjustment motor when PG changeover operation according to an exemplary embodiment of the invention is performed. The vertical axis of the upper diagram of FIG. 11 represents PG amount, which is, for example, a value of platen gap in each position. The vertical axis of the lower diagram of FIG. 11 represents the items of operation. The horizontal axis of each of the upper diagram and the lower diagram of FIG. 11 represents the rotation amount of a PG adjustment motor. FIG. 12 is a flowchart that schematically illustrates an example of a part of the PG changeover operation according to an exemplary embodiment of the invention. Specifically, the flowchart of FIG. 12 schematically illustrates an example of bump-contact driving operation that is performed at the first position side. A more detailed explanation thereof will be given later.

As illustrated in FIG. 11, it is possible to switch PG amount over by rotating the PG adjustment motor 104 in the direction of normal/reverse motor operation. As explained earlier, it is possible to perform the switchover of PG amount by changing over the position of the recording head 19 between the first position, the second position, the third position, and the fourth position. When the printer 11 is powered ON, as a first step, a controlling unit 100, which is illustrated in FIG. 10, calculates the backlash amount of the power transmission mechanism 105 of the PG adjustment unit 50, which includes the first gear 56 and other power transmission components. The backlash calculation explained above is shown as "correction amount calculation" on the vertical axis of the lower diagram of FIG. 11. In the correction amount calculation process, the controlling unit 100 drives the PG adjustment motor 104 in the direction of reverse motor rotation so that the gear projection 57 of the first gear 56 should be brought into "bump contact" with the first bump contact part 22, which is provided at the base-member side. The gear projection 57 of the first gear 56 and the first bump contact part 22 of the base member 21 are illustrated in FIG. 5A.

Thereafter, the controlling unit 100 drives the PG adjustment motor 104 in the direction of normal motor rotation so that the gear projection 57 of the first gear 56 should be brought into bump contact with the second bump contact part 23, which is provided at the base-member side. The gear projection 57 of the first gear 56 and the second bump contact part 23 of the base member 21 are illustrated in FIG. 8A. The controlling unit 100 calculates the backlash amount on the basis of a difference between the theoretical value of the amount of the rotation of the PG adjustment motor 104 that is required for the rotation of the first gear 56 and the actual value of the amount of the rotation of the PG adjustment motor 104 that has been measured with the use of an encoder sensor 102 and an encoder scale 103. The encoder sensor 102 and the encoder scale 103, which are illustrated in FIG. 10, make up an example of a driving amount measurement unit 101. When the PG amount is switched over, the controlling unit 100 drives (e.g., operates or performs driving control on) the PG adjustment motor 104 with the addition of the calculated backlash amount as a correction value.

Needless to say, the controlling unit 100 may have a predetermined correction value. For example, the controlling unit 100 may have a table of values to be added. With such a modified configuration, it is possible to omit the operation process of the correction amount calculation. If the correction amount calculation is skipped, it is possible to shorten the length of an operation time period. It is preferable that the driving amount measurement unit 101 should be provided in the neighborhood of the PG adjustment motor 104 on a path for the transmission of the power of the PG adjustment motor 104. In the configuration of the printer 11 according to the present embodiment of the invention, the encoder scale 103 rotates in the neighborhood of the PG adjustment motor 104 on a power transmission path where the motor power thereof is transmitted by a power transmission belt 106. The power transmission belt 106 is illustrated in FIG. 10. The controlling unit 100 can measure the amount of the rotation of the encoder scale 103 by means of the encoder sensor 102. Therefore, the controlling unit 100 can measure the driving amount of the PG adjustment motor 104 with high precision.

In addition, it is preferable that the gear projection 57, the first bump contact part 22, and the second bump contact part 23 should be provided in the neighborhood of the most downstream position on the path for the transmission of the power of the PG adjustment motor 104 when viewed in the direction of power transmission. In the configuration of the printer 11 according to the present embodiment of the invention, the gear projection 57, the first bump contact part 22, and the second bump contact part 23 are provided in the neighborhood of the most downstream position of the power transmission mechanism 105 when viewed in the direction of power transmission. With such a configuration, it is possible to determine the range of the rotation of each of the first cam 51, the second cam 61, the third cam 71, and the fourth cam 81 with high precision. Therefore, it is possible to determine the range of the movement of the recording head 19 in the Z-axis direction with high precision. Next, it is explained as to how a correction value is added when the PG adjustment motor 104 is driven.

A Switchover from One Intermediate Position to Another Intermediate Position

As an example of a switchover from one intermediate position to another intermediate position, an explanation is given below of a switchover from the second position to the third position, which is denoted as "switchover A". In the configuration of the printer 11 according to the present embodiment of the invention, when the position of the recording head 19, which is mentioned here as an example of each member, is changed over from the second position to the third position, the position thereof is temporarily changed to the first position before a switchover to the third position. This means that the switchover from the second position to the third position is performed not directly but by way of the first position. Accordingly, when the position of the recording head 19 is switched over from the second position to the third position, the gear projection 57 of the first gear 56 is brought into bump contact with the first bump contact part 22 of the base member 21 once at the first-position side before the changeover to the third position.

FIG. 12 is a flowchart that schematically illustrates an example of bump contact operation according to an exemplary embodiment of the invention in which the gear projection of a first gear is brought into bump contact with a first bump contact part, which is provided at the base-member side. As illustrated in FIG. 12, a judgment is made on an APG last-time movement direction flag in a first step S1 of the bump contact operation. Specifically, the controlling unit 100 judges the driving direction of the PG adjustment motor 104 at the time of the end of the last driving operation. If it is judged that the driving direction of the PG adjustment motor 104 at the time of the end of the last driving operation is the direction of normal motor rotation, which is indicated with a movement direction flag "1", the process proceeds to a step S2. On the other hand, if it is judged that the driving direction of the PG adjustment motor 104 at the time of the end of the last driving operation is the direction of reverse motor rotation, which is indicated with a movement direction flag "0", the process proceeds to a step S8. For example, if it is assumed that the current position is the second position and that the position of the recording head 19 changed over from the third position or the fourth position to the second position in the last PG switchover, the last driving direction is the reverse direction. If it is assumed that the current position is the second position and that the position of the recording head 19 changed over from the first position to the second position in the last PG switchover, the last driving direction is the normal direction.

In the step S2, a correction value is set as: LocalAP3=AP3. Specifically, a correction value that will be used in a step S4, which will be explained later, is set as "AP3". More specifically, the correction value "AP3" is the backlash amount calculated by the controlling unit 100 explained above. Thereafter, the process proceeds to a step S3. In the step S3, a judgment is made on the current PG flag. Specifically, the controlling unit 100 makes a judgment on the current PG flag. If the flag indicates that the current position is any of the second position, the third position, and the fourth position, the process proceeds to the step S4. On the other hand, if the flag indicates that the current position is the first position, the process proceeds to a step S5. For example, if the current position is the second position, the process proceeds to the step S4 because the former condition is satisfied; that is, the current position is any of the second position, the third position, and the fourth position.

In the step S4, PF: CCW, Speed: PS3, Driving Amount: |Posi 1 position−Current PG Position|+LocalAP3−AP2*2 is executed. Specifically, the controlling unit 100 causes the PG adjustment motor 104, which functions also as a paper-transport motor, to be rotated in the reverse direction. In such reverse driving, the controlling unit 100 drives the PG adjustment motor 104 at a high speed by the following driving amount: the absolute value of a difference between the first position (i.e., the amount of the rotation of the PG adjustment motor 104 as measured from the position of the first bump contact part 22, which is the reference position) and the current position (i.e., the amount of the rotation of the PG adjustment motor 104 as measured from the reference position of the first bump contact part 22) with the addition of a correction value (i.e., backlash amount) thereto and the subtraction of a very small value therefrom to the extent that the gear projection 57 is not brought into bump contact with the first bump contact part 22. Thereafter, the process proceeds to the step S5.

For example, it is assumed herein that the current position is the second position. Under this assumption, the controlling unit 100 drives the PG adjustment motor 104 by the following driving amount: the absolute value of a difference between the first position (i.e., the amount of the rotation "0" of the PG adjustment motor 104 as measured from the position of the first bump contact part 22, which is the reference position) and the second position (i.e., the amount of the rotation "1000" of the PG adjustment motor 104 as measured from the reference position of the first bump contact part 22) with the addition of a correction value (i.e., backlash amount) thereto and the subtraction of a very small value therefrom to the extent that the gear projection 57 is not brought into bump contact with the first bump contact part 22.

In the step S5, PF bump contact detection driving is carried out. Specifically, a threshold value is set on the current value of the PG adjustment motor 104. In addition, the PG adjustment motor 104 is driven in the reverse rotation direction by predetermined amount at a speed that is lower than that of the preceding step S4. Therefore, it is possible to ensure that the gear projection 57 is brought into bump contact with the first bump contact part 22 at a low speed. Thus, there is no or substantially less risk of damaging the power transmission mechanism 105. Thereafter, the process proceeds to a step S6. In the step S6, a judgment is made as to whether the current value mentioned above has exceeded a threshold value or not. If it is detected that the current value has exceeded the threshold value, the controlling unit 100 judges that the gear projection 57 has been brought into bump contact with the first bump contact part 22. In this case, the process proceeds to a step S7. On the other hand, if it is detected that the current value has not exceeded the threshold value, or, in other words, if the excess is not detected, the controlling unit 100 judges that the gear projection 57 has not been brought into bump contact with the first bump contact part 22. In this case, the process proceeds to a step S9.

In the step S7, Wait 300 msec is performed. Because of the stopping for 300 msec, it is possible to release bearing stress, that is, surface pressure, between the gear projection 57 and the first bump contact part 22. Then, the bump contact sequence ends. In the step S8, it is set as LocalAP3=0. Specifically, the correction value that will be used in the step S4 is set as "0". Thereafter, the process proceeds to the step S3. In the step S9, FATAL error is displayed so as to indicate a PG error. Specifically, it is displayed on a display unit that is provided on the front panel/face of the printer 11. Note that the display unit is not illustrated in the drawing. Then, the bump contact sequence ends.

After the gear projection 57 of the first gear 56 has been brought into bump contact with the first bump contact part 22 of the base member 21, the controlling unit 100 drives the PG adjustment motor 104 so that the PG adjustment motor 104 should be rotated in the normal direction at a high speed. The driving amount equals to the absolute value of a difference between the third position, which is the target position, (i.e., the amount of the rotation "2000" of the PG adjustment motor 104 as measured from the position of the first bump contact part 22, which is the reference position) and the first position (i.e., the amount of the rotation "0" of the PG adjustment motor 104 as measured from the reference position of the first bump contact part 22) with the addition of a correction value (i.e., backlash amount) thereto. In addition, the controlling unit 100 rewrites the PG last-time movement direction flag=1 (driving direction: normal) into the current PG flag=the third position. When the position of the recording head 19 is changed over from the second position to the third position, the switchover is performed not directly from the second position to the third position but by way of the first position. By this means, the changeover to the third position is performed with the addition of a correction value while taking the first position as reference. Therefore, it is possible to determine the third position with high precision.

Notwithstanding the above, however, when the position of the recording head 19 is changed over from the second position to the third position, the switchover may be performed directly from the second position to the third position with the addition of a correction value without going through the first position if the driving direction of the PG adjustment motor 104 at the time of the end of the last driving operation is the direction of reverse motor rotation. Such modified configuration/operation also provides an effective solution to backlash because of the addition of a correction value. That is, there is no adverse possibility that a positional shift gradually occurs in the course of reciprocation between the intermediate positions, that is, between the second position and the third position.

In the foregoing description of bump contact operation according to the present embodiment of the invention, it is explained that the gear projection 57 of the first gear 56 is brought into bump contact with the first bump contact part 22 of the base member 21 as illustrated in the flowchart of FIG. 12. The same explanation as above holds true in a case where the gear projection 57 of the first gear 56 is brought into bump contact with the second bump contact part 23 of the base member 21.

A Switchover from One Intermediate Position to One End Position

As an example of a switchover from one intermediate position to one end position, an explanation is given below of a switchover from the third position to the fourth position, which is denoted as "switchover B". In the configuration of the printer 11 according to the present embodiment of the invention, when the position of the recording head 19 is changed over from the third position to the fourth position, the gear projection 57 of the first gear 56 is brought into bump contact with the second bump contact part 23 of the base member 21 once at the fourth-position side before the changeover to the fourth position as done in the foregoing bump contact operation illustrated in FIG. 12 in which the gear projection 57 of the first gear 56 is brought into bump contact with the first bump contact part 22 of the base member 21 at the first-position side.

In the switchover from the third position to the fourth position, the value in the step S2 is replaced with "0", whereas the value in the step S8 is replaced with "AP3". If the judgment result of the step S3 is any of the first position, the second position, and the third position, the process proceeds to the step S4. If the flag indicates that the current position is the fourth position, the process proceeds to the step S5. In the step S4, the "reverse driving" is replaced with the "normal driving". In addition, the "Posi 1 position" is replaced with the "Posi 4 position". In addition, in the step S5, the "reverse driving (CCW, counterclockwise)" should be read as the "normal driving (CW, clockwise)".

Therefore, it is possible to ensure that the gear projection 57 is brought into bump contact with the second bump contact part 23. As explained above, immediately before the gear projection 57 is brought into bump contact with the second bump contact part 23, the driving speed of the PG adjustment motor 104 is switched over from a high speed to a low speed. Thus, there is no or substantially less risk of damaging the power transmission mechanism 105. In addition, since it is possible to determine the third position with high precision as explained earlier, it is possible to improve positional control immediately before the point of bump contact. Therefore, it is possible to make the high-speed driving interval of the PG adjustment motor 104 as long as possible.

As a result, in comparison with a related-art technique, it is possible to shorten the length of time that is required for a PG switchover. Thus, it is possible to make user-waiting time shorter, which relieves a user from stress.

Thereafter, the controlling unit 100 causes the PG adjustment motor 104 to be rotated in the reverse direction at a high speed by "predetermined steps". Herein, the term "predetermined steps" means very small driving amount that is required for releasing surface pressure between the gear projection 57 and the second bump contact part 23. By this means, it is possible to stabilize PG amount in the fourth position.

A Switchover from One End Position to One Intermediate Position

As an example of a switchover from one end position to one intermediate position, an explanation is given below of a switchover from the fourth position to the second position, which is denoted as "switchover C". For some reasons, when the position of the recording head 19 is changed over from the fourth position to the second position, there is a possibility that the distance between the gear projection 57 and the second bump contact part 23 is greater than a value that corresponds to the predetermined steps mentioned above. If the PG adjustment motor 104 is driven in the reverse direction with the distance between the gear projection 57 and the second bump contact part 23 being greater than a value that corresponds to the predetermined steps, that is, without any correction thereon, there is a risk that a positional shift occurs in the second position after the switchover from the fourth position to the second position, which is supposed to be the right position.

In order to avoid such a positional shift, as a first step of the switchover from the fourth position to the second position, the PG adjustment motor 104 is driven in the normal rotation direction so that the gear projection 57 is brought into bump contact with the second bump contact part 23. The bump contact operation performed in the switchover C described here for bringing the gear projection 57 into bump contact with the second bump contact part 23 is the same as that of the switchover B explained above. Thus, there is no or substantially less risk of damaging the power transmission mechanism 105. In addition, it is possible to determine the fourth position with high precision. Thereafter, the controlling unit 100 drives the PG adjustment motor 104 by the following driving amount: the absolute value of a difference between the second position (i.e., the amount of the rotation "1000" of the PG adjustment motor 104 as measured from the position of the first bump contact part 22, which is the reference position) and the fourth position (i.e., the amount of the rotation "4000" of the PG adjustment motor 104 as measured from the reference position of the first bump contact part 22) with the addition of a correction value (i.e., backlash amount) thereto.

When the position of the recording head 19 is changed over from the fourth position to the second position, the gear projection 57 is brought into bump contact with the second bump contact part 23 once at the fourth-position side. By this means, the changeover to the second position is performed with the addition of a correction value while taking the fourth position as reference. Therefore, it is possible to determine the second position with high precision. Herein, the backlash amount taken as the correction value when the gear projection 57 is brought into bump contact with the first bump contact part 22 at the first-position side is substantially equal to the backlash amount taken as the correction value when the gear projection 57 is brought into bump contact with the second bump contact part 23 at the fourth-position side. For this reason, in the operation of the printer 11 according to the present embodiment of the invention, the same value is used as each correction value. Notwithstanding the above, however, separate measurement may be performed so as to calculate correction values independently. With such a modification, needless to say, it is possible to further improve precision.

The printer 11 according to the present embodiment of the invention, which is a non-limiting example of a "recording apparatus" according to an aspect of the invention, is provided with the recording head 19 that performs recording on a sheet of printing paper P, the platen 15 that is provided opposite to the recording head 19 and supports the sheet of printing paper P, the main guiding shaft 14 and the guide rail unit 33 that support the recording head 19, the first cam 51, the second cam 61, the third cam 71, and the fourth cam 81 that cause the movement of the main guiding shaft 14 and the guide rail unit 33 in the height direction Z, which is a direction along which the recording head 19 and the platen 15 are provided opposite to each other, the power transmission mechanism 105 that transmits power from the PG adjustment motor 104 to the first cam 51, the second cam 61, the third cam 71, and the fourth cam 81, and the controlling unit 100 that drives the PG adjustment motor 104 with the addition of a predetermined correction value if the direction of the rotation of the PG adjustment motor 104 changed over when changing a platen gap, which is a distance from the recording head 19 to the platen 15, through the functioning of and/or as a result of the operation of the first cam 51, the second cam 61, the third cam 71, and the fourth cam 81. The sheet of printing paper P that is described in the present embodiment of the invention is a non-limiting example of a "recording target medium" according to an aspect of the invention. The platen 15 that is described in the present embodiment of the invention is a non-limiting example of a "recording target medium supporting section" according to an aspect of the invention. A set of the main guiding shaft 14 and the guide rail unit 33 that is described in the present embodiment of the invention is a non-limiting example of a "recording head supporting section" according to an aspect of the invention. A set of the first cam 51, the second cam 61, the third cam 71, and the fourth cam 81 that is described in the present embodiment of the invention is a non-limiting example of a "working member" according to an aspect of the invention. The PG adjustment motor 104 that is described in the present embodiment of the invention is a non-limiting example of a "driving power source" according to an aspect of the invention. The controlling unit 100 that is described in the present embodiment of the invention is a non-limiting example of a "controlling section" according to an aspect of the invention.

The printer 11 according to the present embodiment of the invention is provided with the recording head 19 that performs recording on a sheet of printing paper P, the carriage 13 that can move in the direction of the width of the sheet of printing paper P (i.e., width direction X), the platen 15 that is provided opposite to the recording head 19 and supports the sheet of printing paper P, the main guiding shaft 14 and the guide rail unit 33 that support the carriage 13 in such a manner that the carriage 13 moves in the width direction X as guided along the main guiding shaft 14 and the guide rail unit 33, the first cam 51, the second cam 61, the third cam 71, and the fourth cam 81 that cause the movement of the main guiding shaft 14 and the guide rail unit 33 in the height direction Z, which is a direction along which the recording head 19 and the platen 15 are provided opposite to each other, the power transmission mechanism 105 that transmits power from the PG adjustment motor 104 to the first cam 51, the second cam 61, the third cam 71, and the fourth cam 81, and the controlling unit 100 that drives the PG adjustment motor 104 with the addition of a predetermined correction value if the direction of the rotation of the PG adjustment motor 104 changed over when changing a platen gap, which is a distance from the recording head 19 to the platen 15, through the functioning of and/or as a result of the operation of the first cam 51, the second cam 61, the third cam 71, and the fourth cam 81. The sheet of printing paper P that is described herein is a non-limiting example of a recording target medium according to an aspect of the invention. The platen 15 that is described herein is a non-limiting example of a recording target medium supporting section according to an aspect of the invention. A set of the main guiding shaft 14 and the guide rail unit 33 that is described herein is a non-limiting example of a "carriage supporting section" according to an aspect of the invention. A set of the first cam 51, the second cam 61, the third cam 71, and the fourth cam 81 that is described herein is a non-limiting example of a working member according to an aspect of the invention. The PG adjustment motor 104 that is described herein is a non-limiting example of a driving power source according to an aspect of the invention. The controlling unit 100 that is described herein is a non-limiting example of a controlling section according to an aspect of the invention.

The printer 11 according to the present embodiment of the invention is provided with the recording head 19 that performs recording on a sheet of printing paper P, the carriage 13 that can move in the direction X of the width of the sheet of printing paper P, the platen 15 that is provided opposite to the recording head 19 and supports the sheet of printing paper P, the main guiding shaft 14 and the guide rail unit 33 that support the carriage 13 in such a manner that the carriage 13 moves in the width direction X as guided along the main guiding shaft 14 and the guide rail unit 33, the first cam 51, the second cam 61, the third cam 71, and the fourth cam 81 that cause the movement of the main guiding shaft 14 and the guide rail unit 33 in the height direction Z, which is a direction along which the recording head 19 and the platen 15 are provided opposite to each other, the power transmission mechanism 105 that transmits power from the PG adjustment motor 104 to the first cam 51, the second cam 61, the third cam 71, and the fourth cam 81, the encoder sensor 102 and the encoder scale 103 that are used for the measurement of the driving amount of the PG adjustment motor 104, the first bump contact part 22 that determines the position of one end in a movement range in which the main guiding shaft 14 and the guide rail unit 33 are adjusted in their Z-axis positions, that is, moved in the height direction Z, the second bump contact part 23 that determines the position of the other end in the movement range, and the controlling unit 100 that calculates a correction value on the basis of a difference between the theoretical value of the driving amount of the PG adjustment motor 104 and the actual value of the driving amount of the PG adjustment motor 104, the latter of which has been measured with the use of the encoder sensor 102 and the encoder scale 103 after causing or as a result of causing the main guiding shaft 14 and the guide rail unit 33 to move from the one end in the movement range in which the main guiding shaft 14 and the guide rail unit 33 move in the height direction Z to the other end in the movement range, and then drives the PG adjustment motor 104 with the addition of the calculated correction value when changing a distance from the recording head 19 to the platen 15 through the functioning of and/or as a result of the operation of the first cam 51, the second cam 61, the third cam 71, and the fourth cam 81. The encoder sensor 102 and the encoder scale 103 that are described herein make up, as an example thereof, the driving amount measurement unit 101 according to the present embodiment of the invention. The first bump contact part 22 that is described herein is a non-limiting example of a "first movement range delimiting section" according to an aspect of the invention. The second bump contact part 23 that is described herein is a non-limiting example of a "second movement range delimiting section" according to an aspect of the invention.

In addition, in the operation of the printer 11 according to the present embodiment of the invention, if the direction of the rotation of the PG adjustment motor 104 at the time of the start of current driving operation when changing a distance from the recording head 19 to the platen 15 is different from the direction of the rotation of the PG adjustment motor 104 at the time of the completion of the last change of the distance, the controlling unit 100 drives the PG adjustment motor 104 with the addition of the correction value. Moreover, in the operation of the printer 11 according to the present embodiment of the invention, when the main guiding shaft 14 and the guide rail unit 33 are moved from one intermediate position (e.g., the second position), which is not an end position, in the movement range in which the main guiding shaft 14 and the guide rail unit 33 move in the height direction Z to another intermediate position (e.g., the third position) therein, the controlling unit 100 performs control so that the main guiding shaft 14 and the guide rail unit 33 move first from the one intermediate position to one end position (e.g., the first position) in the movement range and thereafter move therefrom to the another intermediate position mentioned above (e.g., the third position).

Furthermore, in the operation of the printer 11 according to the present embodiment of the invention, when the main guiding shaft 14 and the guide rail unit 33 are moved from one end position (e.g., the fourth position) in the movement range in which the main guiding shaft 14 and the guide rail unit 33 move in the height direction Z to other position (e.g., the second position) therein, the controlling unit 100 performs control so as to move the main guiding shaft 14 and the guide rail unit 33 by first rotating the PG adjustment motor 104 in a direction in which the main guiding shaft 14 and the guide rail unit 33 approach the one end position (e.g., the fourth position) in the movement range (i.e., normal driving) and thereafter rotating the PG adjustment motor 104 in a direction opposite thereto (i.e., reverse driving).

In addition, in the operation of the printer 11 according to the present embodiment of the invention, when the main guiding shaft 14 and the guide rail unit 33 are moved to one end position (e.g., the fourth position) in the movement range in which the main guiding shaft 14 and the guide rail unit 33 move in the height direction Z, the controlling unit 100 drives the PG adjustment motor 104 at a high speed when moving the main guiding shaft 14 and the guide rail unit 33 until they approach the one end position (e.g., the fourth position) in the movement range and then switches over the driving speed of the PG adjustment motor 104 from the high speed to a low speed when causing the main guiding shaft 14 and the guide rail unit 33 to approach the one end position (e.g., the fourth position) in the movement range.

The printer 11 according to the present embodiment of the invention is provided with the recording head 19 that performs recording on a sheet of printing paper P, a combination of the first cam 51, the second cam 61, the third cam 71, the fourth cam 81, the PG adjustment motor 104, and the power transmission mechanism 105 that is capable of causing the recording head 19 to move closer to the sheet of printing paper P or move away from the sheet of printing paper P, and the controlling unit 100 that determines driving amount for one driving operation that is performed by the combination of the first cam 51, the second cam 61, the third cam 71, the fourth cam 81, the PG adjustment motor 104, and the power transmission mechanism 105 on the basis of results of a comparison made between a first recording head movement direction (e.g., the forward Z-axis direction, which is shown by the white unfilled arrow in the drawing) that is taken or to be taken in the one driving operation and a second recording head movement direction (e.g., the reverse Z-axis direction, which is the direction opposite to one that is shown by the white unfilled arrow in the drawing) that was taken in another driving operation that is immediately before the one driving operation and thus precedes the one driving operation, wherein the driving amount that is determined when it is judged that the first recording head movement direction (e.g., the forward Z-axis direction) is different from the second recording head movement direction (e.g., the reverse Z-axis direction) is not the same as the driving amount that is determined when it is judged that the first recording head movement direction is the same as the second recording head movement direction. The combination of the first cam 51, the second cam 61, the third cam 71, the fourth cam 81, the PG adjustment motor 104, and the power transmission mechanism 105 that is described herein is a non-limiting example of a "driving mechanism" according to an aspect of the invention. The controlling unit 100 that is described herein is a non-limiting example of a controlling section according to an aspect of the invention.

The printer 11 according to the present embodiment of the invention is provided with the recording head 19 that performs recording on a sheet of printing paper P, a combination of the first cam 51, the second cam 61, the third cam 71, the fourth cam 81, the PG adjustment motor 104, and the power transmission mechanism 105 that is capable of causing the recording head 19 to move closer to the sheet of printing paper P or move away from the sheet of printing paper P, the first bump contact part 22 that determines the position of one end in a movement range in which the recording head 19 is adjusted in its Z-axis position, that is, moved in the height direction Z, the second bump contact part 23 that determines the position of the other end in the movement range, and the controlling unit 100 that performs driving control for moving the recording head 19 to the one end until it becomes impossible for the recording head 19 to move further because the movement thereof is limited by the first bump contact part 22 and thereafter moving the recording head 19 to the other end until it becomes impossible for the recording head 19 to move further because the movement thereof is limited by the second bump contact part 23 so as to acquire the amount of the driving operation as reference driving amount and then determines driving amount for one driving operation that is performed by the combination of the first cam 51, the second cam 61, the third cam 71, the fourth cam 81, the PG adjustment motor 104, and the power transmission mechanism 105 on the basis of the reference driving amount. The combination of the first cam 51, the second cam 61, the third cam 71, the fourth cam 81, the PG adjustment motor 104, and the power transmission mechanism 105 that is described herein is a non-limiting example of a driving mechanism according to an aspect of the invention. The first bump contact part 22 that is described herein is a non-limiting example of a first movement range delimiting section according to an aspect of the invention. The second bump contact part 23 that is described herein is a non-limiting example of a second movement range delimiting section according to an aspect of the invention. The controlling unit 100 that is described herein is a non-limiting example of a controlling section according to an aspect of the invention.

In addition, in the operation of the printer 11 according to the present embodiment of the invention, if the direction of the movement of the recording head 19 at the time of the start of current movement operation (e.g., the forward Z-axis direction, which is shown by the white unfilled arrow in the drawing) when changing a distance from the recording head 19 to a sheet of printing paper P is different from the direction of the movement of the recording head 19 at the time of the completion of the last change of the distance (e.g., the reverse Z-axis direction, which is the direction opposite to one that is shown by the white unfilled arrow in the drawing), the controlling unit 100 makes the determination on the basis of the reference driving amount and drives the combination of the first cam 51, the second cam 61, the third cam 71, the fourth cam 81, the PG adjustment motor 104, and the power transmission mechanism 105.

Moreover, in the operation of the printer 11 according to the present embodiment of the invention, when the recording head 19 is moved from one intermediate position (e.g., the second position), which is not an end position, in the movement range in which the recording head 19 moves in the height direction Z to another intermediate position (e.g., the third position) therein, the controlling unit 100 performs control so that the recording head 19 moves first from the one intermediate position to one end position (e.g., the first position) in the movement range and thereafter moves therefrom to the another intermediate position mentioned above (e.g., the third position).

Furthermore, in the operation of the printer 11 according to the present embodiment of the invention, when the recording head 19 is moved from one end position (e.g., the fourth position) in the movement range in which the recording head 19 moves in the height direction Z to other position (e.g., the second position) therein, the controlling unit 100 performs control so as to move the recording head 19 by first driving the combination of the first cam 51, the second cam 61, the third cam 71, the fourth cam 81, the PG adjustment motor 104, and the power transmission mechanism 105 in a direction in which the recording head 19 approaches the one end position (e.g., the fourth position) in the movement range (i.e., normal driving) and thereafter driving the combination of the first cam 51, the second cam 61, the third cam 71, the fourth cam 81, the PG adjustment motor 104, and the power transmission mechanism 105 in a direction opposite thereto (i.e., reverse driving).

In addition, in the operation of the printer 11 according to the present embodiment of the invention, when the recording head 19 is moved to one end position (e.g., the fourth position) in the movement range in which the recording head 19 moves in the height direction Z, the controlling unit 100 drives the combination of the first cam 51, the second cam 61, the third cam 71, the fourth cam 81, the PG adjustment motor 104, and the power transmission mechanism 105 at a high speed when moving the recording head 19 until it approaches the one end position (e.g., the fourth position) in the movement range and then switches over the driving speed of the combination of the first cam 51, the second cam 61, the third cam 71, the fourth cam 81, the PG adjustment motor 104, and the power transmission mechanism 105 from the high speed to a low speed when causing the recording head 19 to approach the one end position (e.g., the fourth position) in the movement range.

The present invention should be in no case interpreted to be limited to the specific embodiments described above. The invention may be modified, altered, changed, adapted, and/or improved within a range not departing from the gist and/or spirit of the invention apprehended by a person skilled in the art from explicit and implicit description given herein as well as appended claims. Needless to say, a recording apparatus subjected to such a modification, alteration, change, adaptation, and/or improvement is also within the technical scope of the invention.

What is claimed is:

1. A recording apparatus comprising:

a recording head that performs recording on a recording target medium;

a driving mechanism that is capable of causing the recording head to move closer to the recording target medium or move away from the recording target medium;

a first movement range delimiting section that determines the position of one end in a movement range of the recording head;

a second movement range delimiting section that determines the position of the other end in the movement range; and a controlling section that performs driving control for moving the recording head to the one end until it becomes impossible for the recording head to move further because the movement thereof is limited by the first movement range delimiting section and thereafter moving the recording head to the other end until it becomes impossible for the recording head to move further because the movement thereof is limited by the second movement range delimiting section so as to acquire the amount of the driving operation as reference driving amount, wherein a correction value is determined from the reference driving amount and a theoretical driving amount needed for moving the recording head from the one end to the other end of the movement range, wherein the controlling section then determines a driving amount for one driving operation that is performed by the driving mechanism on the basis of the reference driving amount and the correction value.

2. The recording apparatus according to claim 1, wherein, if the direction of the movement of the recording head at the time of the start of current movement operation when changing a distance from the recording head to a recording target medium is different from the direction of the movement of the recording head at the time of the completion of the last change of the distance, the controlling section makes the determination on the basis of the reference driving amount and drives the driving mechanism.

3. The recording apparatus according to claim 1, wherein, when the recording head is moved from one intermediate position, which is not an end position, in the movement range in which the recording head moves in a direction toward a recording target medium or away from the recording target medium to another intermediate position in the movement range, the controlling section performs control so that the recording head moves first from the one intermediate position to one end position in the movement range and thereafter moves therefrom to the another intermediate position.

4. The recording apparatus according to claim 1, wherein, when the recording head is moved from one end position in the movement range in which the recording head moves in a direction toward a recording target medium or away from the recording target medium to other position in the movement range, the controlling section performs control so as to move the recording head by first driving the driving mechanism in a direction in which the recording head approaches the one end position in the movement range and thereafter driving the driving mechanism in a direction opposite thereto.

* * * * *